US007803065B2

(12) United States Patent
Breier et al.

(10) Patent No.: US 7,803,065 B2
(45) Date of Patent: Sep. 28, 2010

(54) GOLF CLUB HEAD

(75) Inventors: Joshua G. Breier, Vista, CA (US); Peter L. Soracco, Carlsbad, CA (US); Scott A. Rice, San Diego, CA (US); Gregory Haralson, Laguna Niguel, CA (US); Charles E. Golden, Encinitas, CA (US); Thomas C. Morris, Carlsbad, CA (US)

(73) Assignee: Cobra Golf, Inc., Carlsbad, CA (US)

( * ) Notice: Subject to any disclaimer, the term of this patent is extended or adjusted under 35 U.S.C. 154(b) by 363 days.

(21) Appl. No.: 11/898,756

(22) Filed: Sep. 14, 2007

(65) Prior Publication Data

US 2008/0039228 A1 Feb. 14, 2008

Related U.S. Application Data

(63) Continuation-in-part of application No. 11/591,588, filed on Nov. 2, 2006, which is a continuation-in-part of application No. 11/363,098, filed on Feb. 28, 2006, now Pat. No. 7,524,249, which is a continuation-in-part of application No. 11/110,733, filed on Apr. 21, 2005, and a continuation-in-part of application No. 11/180,406, filed on Jul. 13, 2005, now Pat. No. 7,377,860.

(51) Int. Cl.
*A63B 53/04* (2006.01)
*A63B 53/06* (2006.01)

(52) U.S. Cl. ..... 473/334; 473/335; 473/345; 473/346; 473/349

(58) Field of Classification Search ..... 473/324–350, 473/287–292
See application file for complete search history.

(56) References Cited

U.S. PATENT DOCUMENTS 3,166,320 A 1/1965 Onions ..... 473/314

(Continued)

FOREIGN PATENT DOCUMENTS

JP 2003-093554 4/2003

(Continued)

OTHER PUBLICATIONS

Notice of Allowance dated Sep. 28, 2009 of corresponding U.S. Appl. No. 11/110,733.

(Continued)

*Primary Examiner*—Sebastiano Passaniti
(74) *Attorney, Agent, or Firm*—Knobbe, Martens, Olson & Bear LLP

(57) ABSTRACT

A hollow golf club head with a concave portion is disclosed and claimed. The club head includes a metallic portion and a light-weight portion, which may be formed of plastic, composite, or the like. The concave portion allows the club designer to make a club head having very thin portions while still maintaining the requisite structural integrity. Convex bulges may optionally be provided to house weight inserts to enhance the playing characteristics of the golf club. The metallic portion of the club head may take on the appearance of a frame, into which several light-weight inserts are positioned. These light-weight inserts may be positioned in the crown, skirt, and sole of the club head. The club head may be formed by co-molding, eliminating the need for welding or adhesives, freeing mass to be used in more beneficial ways. The club head may be large to increase playability and forgiveness. The club head may include one or more light-weight inserts to manipulate the playing characteristics of the resulting golf club. These inserts may have attachment surfaces that are relatively angled such that the inserts are subjected to compressive forces rather than shear forces upon impact with a golf ball during a golf swing.

25 Claims, 18 Drawing Sheets

U.S. PATENT DOCUMENTS

| | | | | |
|---|---|---|---|---|
| 3,941,390 | A | 3/1976 | Hussey | |
| 3,966,210 | A | 6/1976 | Rozmus | 473/341 |
| 4,021,047 | A | 5/1977 | Mader | |
| 4,653,756 | A | 3/1987 | Sato | |
| 4,792,140 | A | 12/1988 | Yamaguchi et al. | 473/331 |
| 4,869,507 | A | 9/1989 | Sahm | 473/337 |
| 4,872,683 | A | 10/1989 | Doran et al. | 473/249 |
| 5,186,465 | A | 2/1993 | Chorne | |
| 5,205,560 | A | 4/1993 | Hoshi et al. | 473/345 |
| 5,213,328 | A | 5/1993 | Long et al. | |
| 5,255,913 | A | 10/1993 | Tsuchida | 473/329 |
| 5,272,802 | A | 12/1993 | Stites, III | |
| 5,310,186 | A | 5/1994 | Karsten | |
| 5,346,217 | A | 9/1994 | Tsuchiya et al. | 473/345 |
| 5,435,558 | A | 7/1995 | Iriarte | |
| 5,624,331 | A * | 4/1997 | Lo et al. | 473/345 |
| 5,769,736 | A | 6/1998 | Sato | 473/335 |
| 5,785,609 | A | 7/1998 | Sheets et al. | |
| 5,947,840 | A | 9/1999 | Ryan | 473/335 |
| 5,997,415 | A * | 12/1999 | Wood | 473/346 |
| D418,885 | S | 1/2000 | Wanchena | |
| 6,012,989 | A | 1/2000 | Saksun | 473/341 |
| 6,123,627 | A | 9/2000 | Antonious | 473/327 |
| 6,139,446 | A | 10/2000 | Wanchena | |
| 6,162,133 | A | 12/2000 | Peterson | |
| 6,183,377 | B1 * | 2/2001 | Liang | 473/324 |
| 6,217,461 | B1 * | 4/2001 | Galy | 473/328 |
| 6,248,025 | B1 | 6/2001 | Murphy et al. | |
| 6,248,026 | B1 | 6/2001 | Wanchena | |
| 6,332,848 | B1 | 12/2001 | Long et al. | |
| 6,354,962 | B1 | 3/2002 | Galloway et al. | 473/342 |
| 6,409,612 | B1 | 6/2002 | Evans et al. | 473/324 |
| 6,422,951 | B1 | 7/2002 | Burrows | 473/328 |
| 6,440,009 | B1 | 8/2002 | Guibaud et al. | 473/334 |
| 6,482,106 | B2 | 11/2002 | Saso | 473/327 |
| 6,565,452 | B2 | 5/2003 | Helmstetter et al. | 473/342 |
| 6,575,845 | B2 | 6/2003 | Galloway et al. | 473/329 |
| 6,645,086 | B1 | 11/2003 | Chen | 473/335 |
| 6,648,773 | B1 | 11/2003 | Evans | 473/342 |
| 6,739,984 | B1 | 5/2004 | Ciasullo | 473/345 |
| 6,773,360 | B2 | 8/2004 | Willett et al. | 473/334 |
| 6,860,818 | B2 * | 3/2005 | Mahaffey et al. | 473/256 |
| 6,872,152 | B2 | 3/2005 | Beach et al. | 473/324 |
| 6,929,565 | B2 | 8/2005 | Nakahara et al. | 473/345 |
| 6,955,612 | B2 * | 10/2005 | Lu | 473/324 |
| 7,008,332 | B2 * | 3/2006 | Liou | 473/345 |
| 7,025,692 | B2 | 4/2006 | Erickson et al. | 473/335 |
| 7,070,517 | B2 | 7/2006 | Cackett et al. | 473/342 |
| 7,140,974 | B2 | 11/2006 | Chao et al. | 473/329 |
| 7,147,573 | B2 * | 12/2006 | DiMarco | 473/324 |
| 7,160,040 | B2 | 1/2007 | Matsushima | 400/62 |
| 7,163,468 | B2 | 1/2007 | Gibbs et al. | 473/329 |
| 7,166,038 | B2 | 1/2007 | Williams et al. | 473/329 |
| 7,258,625 | B2 * | 8/2007 | Kawaguchi et al. | 473/329 |
| 7,303,487 | B2 | 12/2007 | Kumamoto | 473/345 |
| D567,888 | S | 4/2008 | Soracco | D21/752 |
| 7,371,191 | B2 | 5/2008 | Sugimoto | 473/345 |
| 7,377,860 | B2 | 5/2008 | Breier et al. | 473/334 |
| 7,524,249 | B2 | 4/2009 | Breier et al. | 473/342 |
| 2001/0001302 | A1 | 5/2001 | Murphy et al. | |
| 2001/0049310 | A1 | 12/2001 | Cheng et al. | |
| 2002/0045490 | A1 | 4/2002 | Ezawa et al. | |
| 2002/0137576 | A1 | 9/2002 | Dammen | |
| 2003/0045371 | A1 | 3/2003 | Wood et al. | |
| 2003/0100381 | A1 | 5/2003 | Murphy | |
| 2003/0144078 | A1 | 7/2003 | Setokawa et al. | |
| 2004/0138002 | A1 | 7/2004 | Murray | |
| 2004/0176177 | A1 | 9/2004 | Mahaffey et al. | |
| 2004/0192468 | A1 * | 9/2004 | Onoda et al. | 473/345 |
| 2004/0242343 | A1 | 12/2004 | Chao et al. | |
| 2004/0254030 | A1 * | 12/2004 | Nishitani et al. | 473/345 |
| 2005/0119070 | A1 | 6/2005 | Kumamoto | |
| 2005/0159243 | A1 | 7/2005 | Chuang | |
| 2005/0170907 | A1 | 8/2005 | Saso | |
| 2005/0215354 | A1 * | 9/2005 | Kumamoto | 473/349 |
| 2005/0272527 | A1 * | 12/2005 | Sugimoto | 473/345 |
| 2006/0014592 | A1 * | 1/2006 | Sugimoto | 473/345 |
| 2006/0052177 | A1 * | 3/2006 | Nakahara et al. | 473/329 |
| 2006/0052181 | A1 * | 3/2006 | Serrano et al. | 473/345 |

FOREIGN PATENT DOCUMENTS

| | | |
|---|---|---|
| JP | 2004-121744 | 4/2004 |
| JP | 2004-159680 | 6/2004 |
| JP | 2004-337327 | 12/2004 |
| JP | 2006-25929 | 2/2006 |
| WO | WO2004/052472 | 6/2004 |

OTHER PUBLICATIONS

Non-Final Office Action dated May 20, 2009 of corresponding U.S. Appl. No. 11/110,733.
Final Office Action dated Oct. 1, 2008 of corresponding U.S. Appl. No. 11/110,733.
Non-Final Office Action dated Dec. 31, 2007 of corresponding U.S. Appl. No. 11/110,733.
Non-Final Office Action dated Jun. 5, 2007 of corresponding U.S. Appl. No. 11/110,733.
Notice of Allowance dated Dec. 31, 2008 of corresponding U.S. Appl. No. 11/363,098.
Non-Final Office Action dated Jun. 12, 2008 of corresponding U.S. Appl. No. 11/363,098.
Non-Final Office Action dated Oct. 27, 2009 of corresponding U.S. Appl. No. 11/591,588.
Non-Final Office Action dated Dec. 7, 2009 of corresponding U.S. Appl. No. 11/898,756.
Non-Final Office Action dated Nov. 13, 2009 of corresponding U.S. Appl. No. 11/600,081.

* cited by examiner

GOLF CLUB HEAD

CROSS-REFERENCE TO RELATED APPLICATIONS

This is a continuation-in-part of U.S. patent application Ser. No. 11/591,588 filed on Nov. 2, 2006, now pending, which is a continuation-in-part of U.S. patent application Ser. No. 11/363,098 filed on Feb. 28, 2006, now U.S. Pat. No. 7,524,249, which is 1) a continuation-in-part of U.S. patent application Ser. No. 11/110,733 filed on Apr. 21, 2005, now pending, and 2) a continuation-in-part of U.S. patent application Ser. No. 11/180,406 filed on Jul. 13, 2005, now U.S. Pat. No. 7,377,860. Each of these documents is incorporated herein by reference in its entirety.

BACKGROUND OF THE INVENTION

1. Field of the Invention

The present invention relates to a golf club, and, more particularly, the present invention relates to a large wood-type golf club head with improved physical attributes.

2. Description of the Related Art

Golf club heads come in many different forms and makes, such as wood- or metal-type (including drivers and fairway woods), iron-type (including wedge-type club heads), utility- or specialty-type, and putter-type. Each of these styles has a prescribed function and make-up. The present invention primarily relates to hollow golf club heads, such as wood-type and utility-type (generally referred to herein as wood-type golf clubs).

Wood-type type golf club heads generally include a front or striking face, a crown, a sole, and an arcuate skirt including a heel, a toe, and a back. The crown and skirt are sometimes referred to as a "shell." The front face interfaces with and strikes the golf ball. A plurality of grooves, sometimes referred to as "score lines," may be provided on the face to assist in imparting spin to the ball and for decorative purposes. The crown is generally configured to have a particular look to the golfer and to provide structural rigidity for the striking face. The sole of the golf club contacts and interacts with the ground during the swing.

The design and manufacture of wood-type golf clubs requires careful attention to club head construction. Among the many factors that must be considered are material selection, material treatment, structural integrity, and overall geometrical design. Exemplary geometrical design considerations include loft, lie, face angle, horizontal face bulge, vertical face roll, face size, sole curvature, center of gravity, and overall head weight. The interior design of the club head may be tailored to achieve particular characteristics, such as by including hosel or shaft attachment means, perimeter weighting on the face or body of the club head, and fillers within hollow club heads. Club heads typically are formed from stainless steel, aluminum, or titanium, and are cast, stamped as by forming sheet metal with pressure, forged, or formed by a combination of any two or more of these processes. The club heads may be formed from multiple pieces that are welded or otherwise joined together to form a hollow head, as is often the case of club heads designed with inserts, such as sole plates or crown plates. The multi-piece constructions facilitate access to the cavity formed within the club head, thereby permitting the attachment of various other components to the head such as internal weights and the club shaft. The cavity may remain empty, or may be partially or completely filled, such as with foam. An adhesive may be injected into the club head to provide the correct swing weight and to collect and retain any debris that may be in the club head. In addition, due to difficulties in manufacturing one-piece club heads to high dimensional tolerances, the use of multi-piece constructions allows the manufacture of a club head to a tight set of standards.

It is known to make wood-type golf clubs out of metallic materials. These clubs were originally manufactured primarily by casting durable metals such as stainless steel, aluminum, beryllium copper, etc. into a unitary structure comprising a metal body, face, and hosel. As technology progressed, it became more desirable to increase the performance of the face of the club, usually by using a titanium material.

With a high percentage of amateur golfers constantly searching for more distance on their shots, particularly their drives, the golf industry has responded by providing golf clubs specifically designed with distance in mind. The head sizes of wood-type golf clubs have increased, allowing the club to possess a higher moment of inertia, which translates to a greater ability to resist twisting on off-center hits. As a wood-type club head becomes larger, its center of gravity will be moved back away from the face and further toward the toe, resulting in hits flying higher and further to the right than expected (for right-handed golfers). Reducing the lofts of the larger head clubs can compensate for this. Because the center of gravity is moved further away from hosel axis, the larger heads can also cause these clubs to remain open on contact, thereby inducing a "slice" effect (in the case of a right-handed golfer the ball deviates to the right). Offsetting the head and/or incorporating a hook face angle can help compensate for this by "squaring" the face at impact, but often more is required to eliminate the "slice" tendency.

Another technological breakthrough in recent years to provide the average golfer with more distance is to make larger head clubs while keeping the weight constant or even lighter by casting consistently thinner shell thicknesses and using lighter materials such as titanium, magnesium, and composites. Also, the faces of the clubs have been steadily becoming extremely thin, because a thinner face will maximize what is known as the Coefficient of Restitution (COR). The more a face rebounds upon impact, the more energy is imparted to the ball, thereby increasing the resulting shot distance.

Known methods to enhance the weight distribution of wood-type club heads to help reduce the club from being open upon contact with the ball usually include the addition of weights to the body casting itself or strategically adding a weight element at some point in the club. Many efforts have been made to incorporate weight elements into the wood-type club head. These weight elements are usually placed at specific locations, which will have a positive influence on the flight of the ball or to overcome a particular golfer's shortcomings. As previously stated, a major problem area of the higher handicap golfer is the tendency to "slice," which in addition to deviating the ball to the right also imparts a greater spin to the ball, further reducing the overall shot distance. To reduce this tendency, the present patent teaches the placement of weight elements directly into the club head. The placement of weight elements is designed so that the spin of the ball will be reduced, and also a "draw" (a right-to-left ball flight for a right-handed golfer) will be imparted to the ball flight. This ball flight pattern is also designed to help the distance-challenged golfer because a ball with a lower spin rate will generally roll a greater distance after initially contacting the ground than would a ball with a greater spin rate.

SUMMARY OF THE INVENTION

The present invention relates to a large wood-type golf club head with improved playing characteristics. The club head may be formed of a plurality of body members that define an interior volume. A first body member is made of a metallic material and includes a sole portion and a face portion. A second body portion is made of a light-weight material, such as plastic, composite, or a very thin sheet of low density metallic material. The second body portion makes up at least a portion of the club head skirt, and includes one or more concave indentations that extends into the interior volume of the club head. These indentations provide structural integrity to the second body portions, which may be very thin panels.

The second body member optionally may also include one or more convex bulges that generally extend away from the interior volume. Inserts, such as weight inserts, may be positioned within the convex bulges. Careful positioning of the weight inserts allows the designer to enhance the playing characteristics of the golf club and tailor the club for a specific swing type. The first body member may form a large portion of the club head sole, and the second body member may form a large portion of the club head crown. This weight positioning further enhances the playing characteristics of the golf club.

The club head may include secondary weights positioned extremely low and back from the striking face. A center point on the sole plate defines the lowest point on the club head, and in one embodiment the center point is located directly below the club head center of gravity when the club head is at a 59° lie angle. The center of gravity of the secondary weights are positioned a predetermined distance from the center point. Preferably, each secondary weight center of gravity is at least 0.5 inch rearward of the center point, at least 0.75 inch from the center point toward the heel for the heel weight or at least 0.75 inch from the center point toward the toe for the toe weight, and a maximum 0.25 inch above the center point, whereby the positions of the secondary weights alter the traditional look of the golf club head by bulging outward of the natural contour of the club head.

The secondary weights may be located by reference to a point at which the hosel centerline intersects the sole plate. This distance is then measured from the back surface of the striking face at the midpoint thereof to determine an intersection point. Preferably, the secondary weights are each at least 1.50 inches rearward of the intersection point, at least 0.75 inch toward either the heel or the toe, and a maximum of 0.25 inch above the center point with the club head at a 59° lie angle.

The club head may include an inventive combination of geometric and physical features. For example, the club head may have a large striking surface area, a large face length, and/or a large face height. Increasing the size of the striking face increases the sweet spot, making the golf club more forgiving and, therefore, more playable.

The club head may have a large depth, measured in a face-to-rear direction. Increasing the club head depth moves the center of gravity rearward, which also makes the club head more playable. This aspect of the invention may be quantified in a variety of manners, such as crown surface area. Preferably, the golf club head has a large crown surface area. To further enhance these beneficial attributes, the crown may be sloped from the striking face rearward, with at least a portion of the crown being below the club head center of gravity. Preferably, a substantial portion of the crown periphery is located below (on a sole side) the club head center of gravity.

To manipulate the club head center of gravity and moment of inertia properties, and therefore the playing characteristics and attributes of the resulting golf club, the club head of the present invention may include one or more light-weight inserts, such as the second body portion mentioned above. These inserts may include attachment surfaces that are relatively angled such that the inserts are subjected to compressive forces rather than shear forces upon impact with a golf ball during a golf swing.

The club head may be formed in a variety of manners. One such manner is by co-molding, a manufacturing process in which two dissimilar materials are joined directly together by molding one of the materials to the other. For example, a metallic portion of the club head can form at least part of a mold used to form a second portion of the club head from a light-weight material such as plastic or a composite material. Other mold pieces may also be used in conjunction with the metallic portion of the club head. Co-molding eliminates the need for welding or adhesives. The club head designer is free to use the mass that would have been taken up by these known attachment means in other, more beneficial ways without increasing the overall mass of the club head. Such beneficial uses of the "freed-up" mass include increasing the overall size of the club head, expanding the size of the club head sweet spot, repositioning the club head center of gravity, and/or producing a greater moment of inertia.

DESCRIPTION OF THE DRAWINGS

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
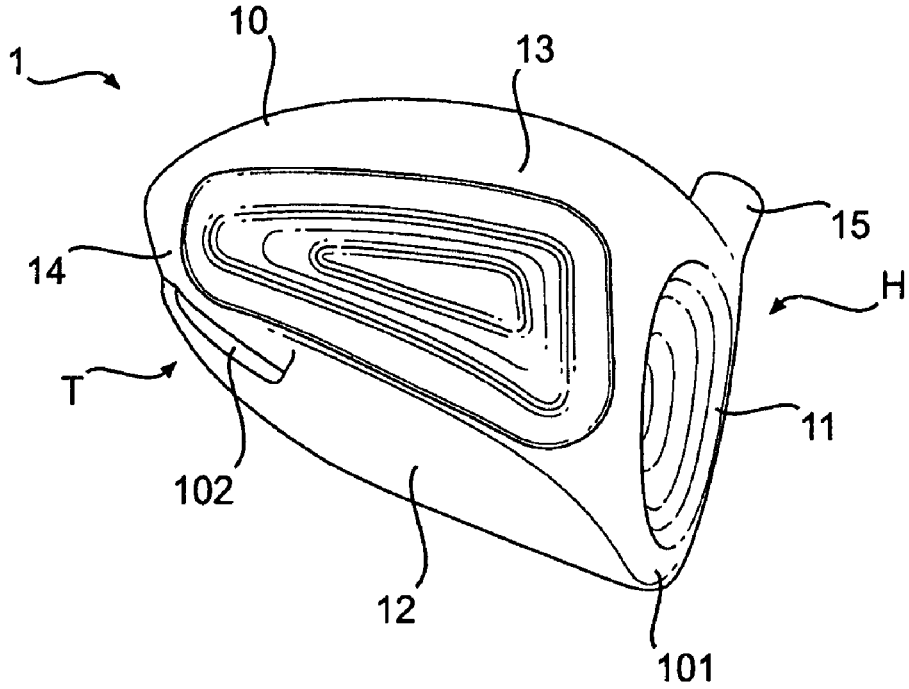
FIG. 1 shows a golf club head of the present invention.

FIG. 1 shows a golf club head 1 of the present invention. The club head 1 includes a body 10 having a strike face 11, a sole 12, a crown 13, a skirt 14, and a hosel 15. The body 10 defines a hollow, interior volume 16. Foam or other material may partially or completely fill the interior volume 16. Weights may optionally be included within the interior volume 16. The face 11 may be provided with grooves or score lines therein of varying design. The club head 1 has a toe T and a heel H.

Figure 2:
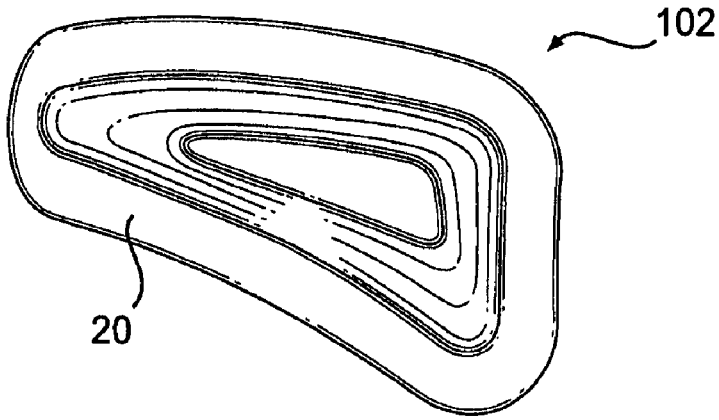
FIG. 2 shows a body member of the golf club head of FIG. 1.

In this illustrated embodiment of FIG. 1, the club head 1 is comprised of a plurality of body members that cooperatively define the interior volume 16. A first body member 101 includes a sole portion and a face portion. The first body member 101 may include a complete face 11 and sole 12. Alternatively, either or both the face 11 and the sole 12 can be inserts coupled to the first body member 101. The club head 1 also includes at least one second body member 102 coupled to the first body member 101 along the skirt 14 in known fashion. The crown 13 can be unitarily a portion of either body member 101, 102 or it may be an insert coupled to either of the body members 101, 102. The second body member 102 includes a concave portion 20 that, when the body members 101, 102 are coupled together, extends inward into the interior volume 16. FIG. 2 shows an isolated view of an exemplary second body member 102.

The first body member 101 preferably is formed of a metallic material such as stainless steel, aluminum, or titanium. The material of the first body member 101 is chosen such that it can withstand the stresses and strains incurred during a golf swing, including those generated through striking a golf ball or the ground. The club head 1 can be engineered to create a primary load bearing structure that can repeatedly withstand such forces. Other portions of the club head 1, such as the skirt 14, experience a reduced level of stress and strain and advantageously can be replaced with a lighter, weight-efficient secondary material. Lighter weight materials, such as low density metal alloys, plastic, composite, and the like, which have a lower density or equivalent density than the previously mentioned metallic materials, can be used in these areas, beneficially allowing the club head designer to redistribute the "saved" weight or mass to other, more beneficial locations of the club head 1. These portions of the club head 1 can also be made thinner, enhancing the weight savings. Exemplary uses for this redistributed weight include increasing the overall size of the club head 1, expanding the size of the club head "sweet spot," which is a term that refers to the area of the face 11 that results in a desirable golf shot upon striking a golf ball, repositioning the club head 1 center of gravity, and/or producing a greater moment of inertia (MOI). Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off-center hits since less energy is lost during impact from club head twisting. Moving or rearranging mass to the club head perimeter enlarges the sweet spot and produces a more forgiving club. Increasing the club head size and moving as much mass as possible to the extreme outermost areas of the club head 1, such as the heel H, the toe T, or the sole 12, maximizes the opportunity to enlarge the sweet spot or produce a greater MOI, making the golf club hotter and more forgiving.

The second body member 102 is light-weight, which gives the opportunity to displace the club head center of gravity downward and to free weight for more beneficial placement elsewhere without increasing the overall weight of the club head 1. When the wall thickness of the second body member 102 is at the minimum range of the preferred thickness, a reinforcing body layer can be added in the critical areas in case the member shows deformations. These benefits can be further enhanced by making the second body member 102 thin. To ensure that the structural integrity of the club head 1 is maintained, these thin panels may preferably include a concave portion 20. Inclusion of these concave portions 20 allow the second body member 102 to withstand greater stress—both longitudinally and transversely—without sustaining permanent deformation or affecting the original cosmetic condition, ensuring the structural integrity of the club head 1 is maintained. Preferred thicknesses for the first body member 101 include from 0.03 inch to 0.05 inch, while preferred thicknesses for the second body member 102 include from 0.015 inch to 0.025 inch. Preferably, the concave portion 20 displaces at least 10 cubic centimeters. More preferably, the concave portion 20 displaces at least 25 cubic centimeters. While the club head 1 can be virtually any size, preferably it is a legal club head. A plurality of concave portions 20 may be used with the club head 1. For example, concave portions 20 of uniform or varying size may be positioned in the toe, heel, back, etc.

Figure 3:
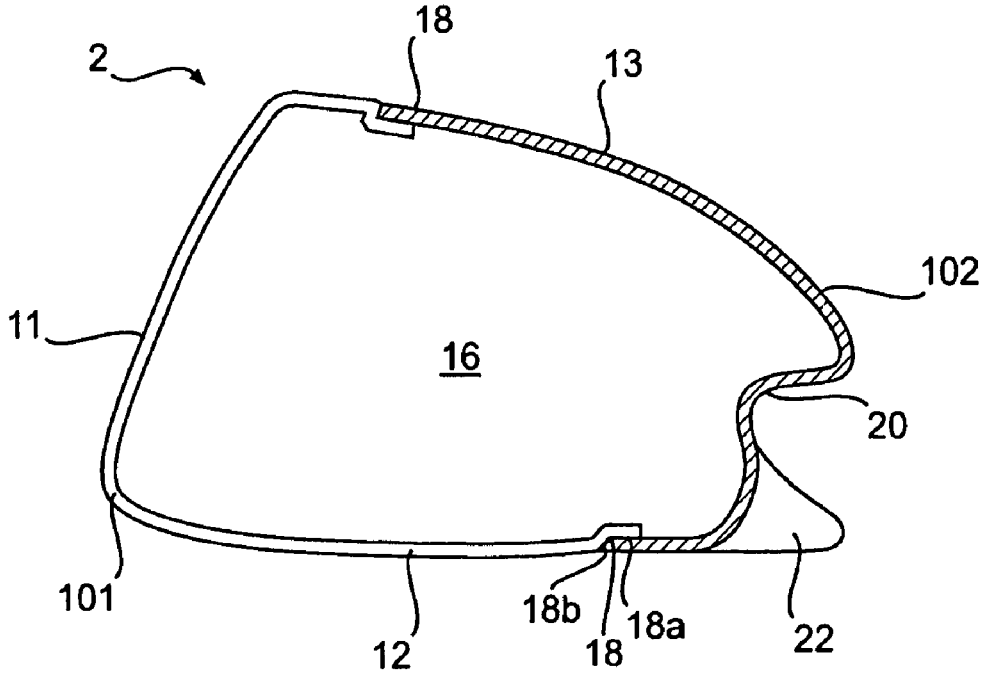
FIG. 3 shows a second club head of the present invention.
Figure 4:
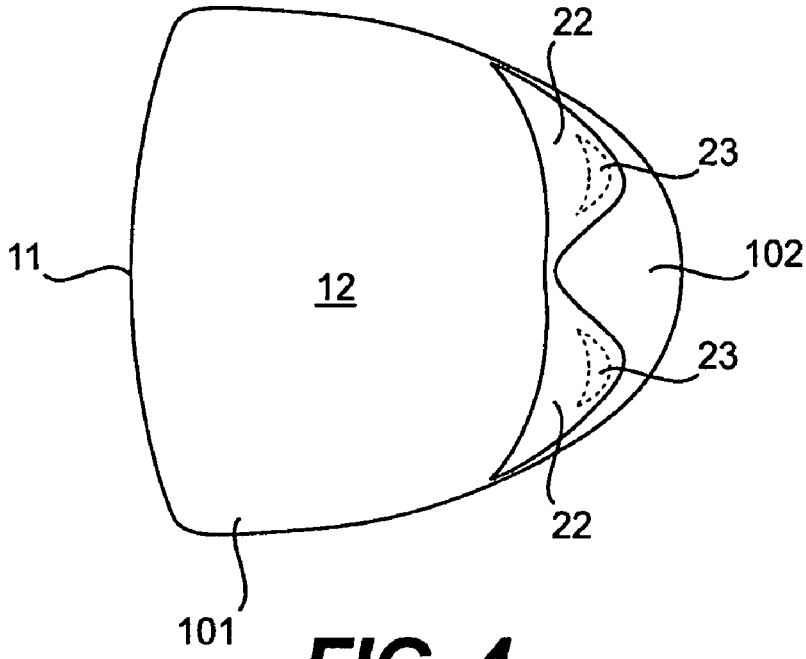
FIG. 4 shows a bottom view of the club head of FIG. 3.
Figure 5:
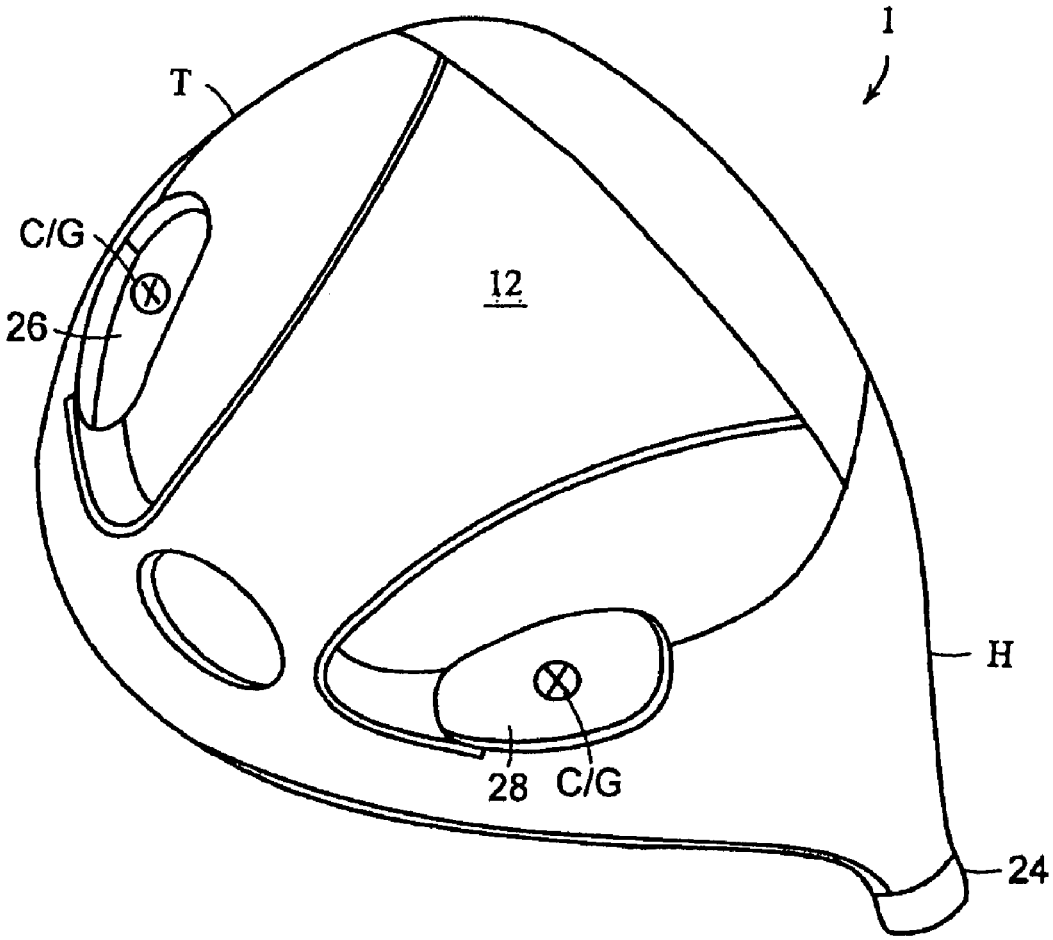
FIG. 5 shows a bottom perspective view of a club head of the present invention.
Figure 6:
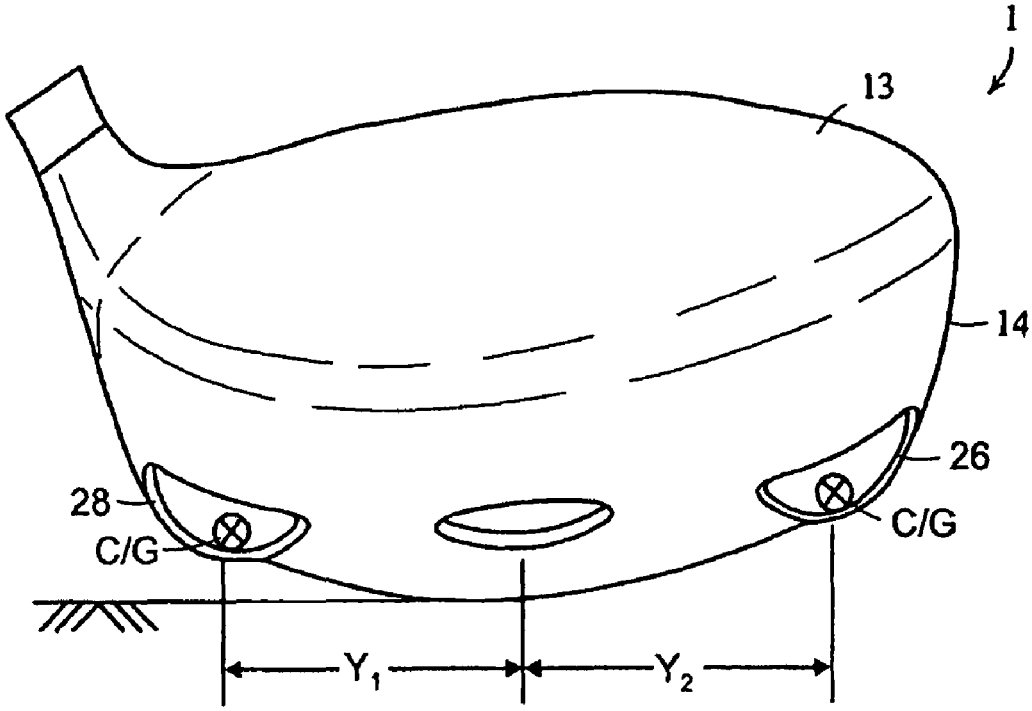
FIG. 6 shows a rear elevation view of the club head of FIG. 5.
Figure 7:
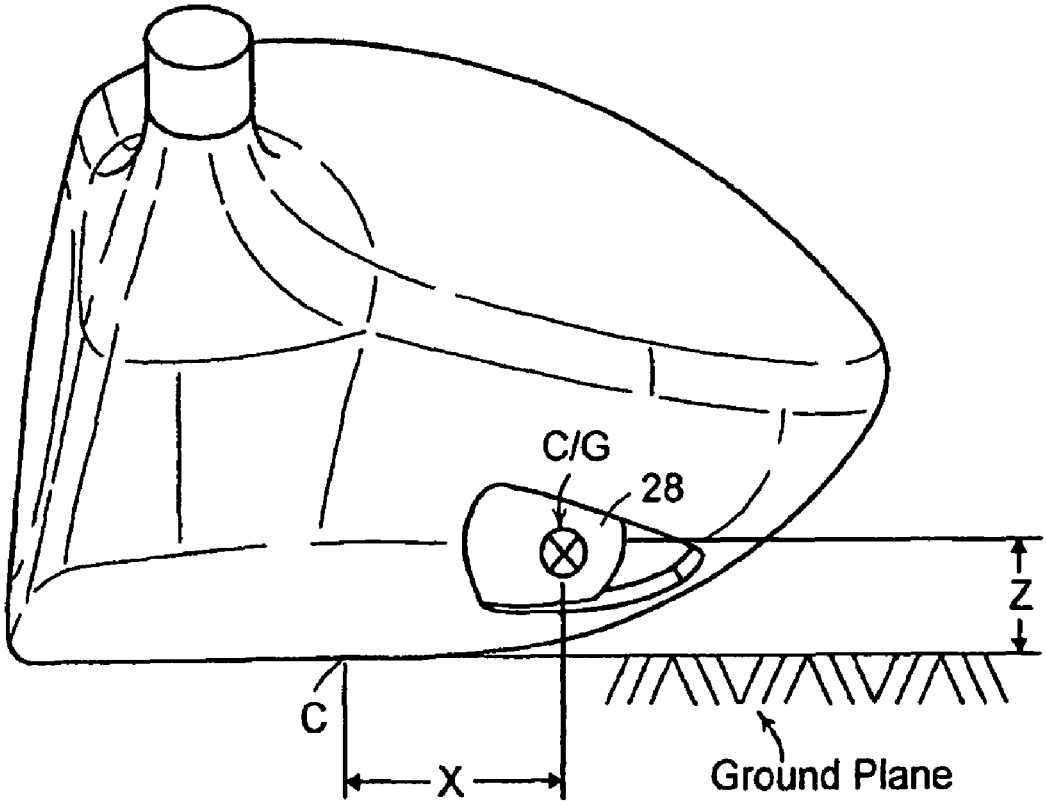
FIG. 7 shows a heel elevation view of the club head of FIG. 5.

FIG. 3 shows a cross-sectional view taken substantially perpendicular to the face 11 of a second club head 2 of the present invention, and FIG. 4 shows a bottom view of the club head 2. In the illustration of this embodiment, the concave portion 20 is positioned at the back of the club head 2. The concave portion 20 preferably is not visible to the golfer at address. In addition to the concave portion 20, the second body member 102 further includes a convex bulge 22 that extends generally away from the interior volume 16. An insert 23 may be positioned within the convex bulge. The insert 23 is not visible from outside the club head 2, and is thus illustrated using broken lines. In a preferred embodiment, the insert 23 is a weight insert. The convex nature of the bulge 23 allows the weight to be positioned to maximize the mechanical advantage it lends to the club head 2. As shown in FIG. 4, the club head 2 may include a plurality of convex bulges 22, such as on a heel side and on a toe side of the club head 2. The club designer may place inserts 23 as desired within the bulges 22. The masses of the inserts may be substantially equal. Alternatively, one of the inserts may have a greater mass than the other. This may be beneficial to design the club to correct a hook swing or a slice swing. A preferred mass range for the weight insert 23 is from 1 gram to 50 grams.

As shown in FIG. 3, the first body member 101 may comprise a majority of the sole 12 and the second body member 102 may include a majority of the crown 13. This beneficially removes a large majority of the mass from the upper part of the club head 2. In this embodiment the first body member 101 includes an attachment perimeter 18 that extends around its edge. The second body member 102 is coupled to the first body member 101 along the attachment perimeter 18. The first and second body members 101, 102 cooperatively define the interior volume 16. The attachment perimeter 18 preferably may contain a step defining two attachment surfaces 18*a*, 18*b*. As illustrated, the second body member 102 may be coupled to both of these surfaces 18*a*, 18*b* to help ensure a strong bond between the body members 101, 102.

While the body members 101, 102 may be formed in a variety of manners, a preferred manner includes forming a complete club head shell (first body member 101) in known manner and removing material to create openings to which the second body member 102 can be coupled. The opening may be created in any desired manner, such as with a laser. The second body member 102 may be joined to the first body member 101 in a variety of manners, such as through bonding or through a snap-fit in conjunction with bonding. If a composite material is used for the concave inserts, molding six plies of 0/90/45/-45/90/0 is preferred.

FIGS. 5-9 illustrate additional aspects of the present invention. In the embodiment illustrated in these figures, the club head 1 includes a crown portion 13, a sole 12, a heel portion H, a toe portion T, a skirt portion 14 connecting the heel portion H to the toe portion T, a front face 11 and a hosel 24 that extends from the heel portion H. The club head 1 can be formed from sheets joined together, such as by welding, or cast, preferably from a titanium alloy. The crown portion 13 can be made from such materials as carbon fiber composite, polypropylene, Kevlar, magnesium, or a thermoplastic. Hosel 24 includes a bore defining a centerline axis C/L.

Figure 8:
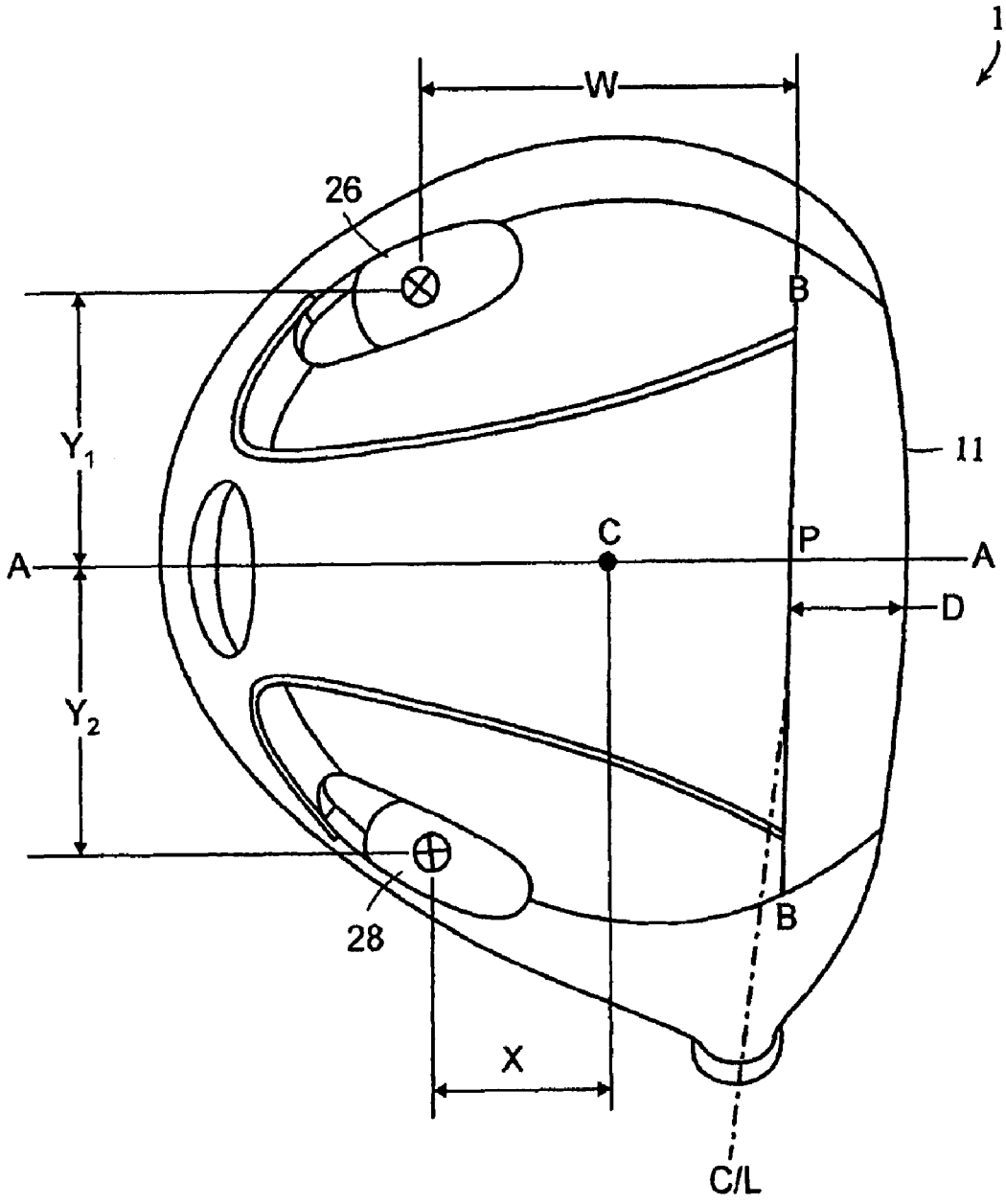
FIG. 8 shows a bottom schematic view of the club head of FIG. 5.
Figure 9:
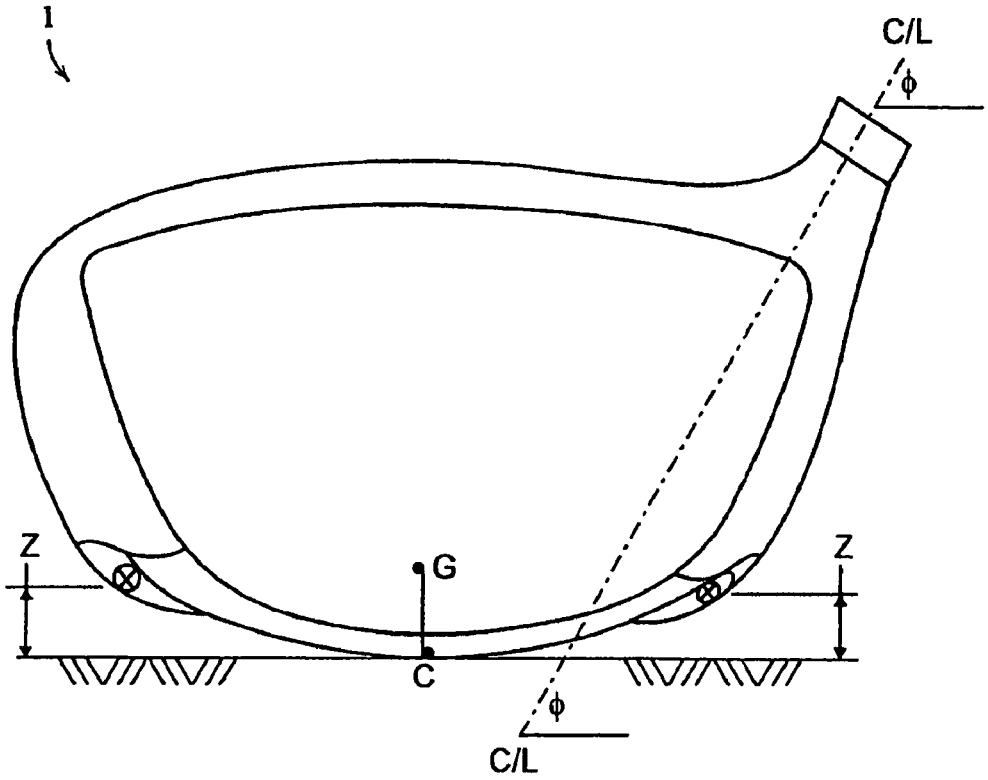
FIG. 9 shows a front cross-sectional view of the club head of FIG. 5.

As best depicted in FIG. 9, the club head 1 of the present invention has a center of gravity G located at an extremely rearward and low position. The location of the center of gravity G is biased by the location of two secondary weights, a toe secondary weight 26 and a heel secondary weight 28, which are both partially outside the traditional look of a golf club head. As shown in FIGS. 5-9, the locations of the two secondary weight elements 26, 28 are established by the relationship of their distances from established points of contact. When the club head is at a lie angle ø of 59°, the lowest contact point of the sole 12 is at a center point C directly beneath the center of gravity G.

One method of establishing the locations of the secondary weights 26, 28 is discussed herein. As shown in FIG. 8, the center line C/L of hosel 24 intersects the sole plate 12 at a distance D from the rear surface of the front face 11. When extending a line B-B that is substantially parallel to the leading edge of the club head (maintaining the distance D), an intersection point P is made with a line A-A that is perpendicular to and extends rearward from the midpoint of the front face 11. The line A-A extends through the middle of the club head 1 and passes directly beneath the club head center of gravity G. This intersection point P may also be defined by the intersection of line A-A and a vertical plane positioned at an intersection of the hosel center line C/L and the sole 12. The center of gravity C/G of each secondary weight 26, 28 is at a distance W of at least 1.50 inches rearward of the intersection point P, a distance Z that is a maximum of 0.25 inch above the lowest point of contact, which is the center point C of the sole plate 12, and each secondary weight is at least 0.75 inch away from line A-A in opposing directions, which is a distance Y1 towards the toe T for the toe secondary weight 26 and a distance Y2 towards the heel H for the heel secondary weight 28.

The locations of the secondary weights 26, 28 may also be determined for the present invention by measuring from the center point C. From center point C, the center of gravity of each secondary weight 26, 28 is a distance X of at least 0.50 inch rearward along line A-A, the distance Z that is a maximum of 0.25 inch above the center point C, and a minimum of 0.75 inch away from line A-A in opposing directions, towards the toe T for the toe secondary weight 26 and towards the heel H for the heel secondary weight 28. Thus, each secondary weight 26, 28 is a minimum of 0.90 inch from the center point C.

The secondary weights 26, 28 can be selected from a plurality of weights designed to make specific adjustments to the club head weight. The secondary weights 26, 28 can be welded into place or attached by a bonding agent. The weights 26, 28 can be formed from typically heavy weight inserts such as steel, nickel, or tungsten. Preferably, the body of the club head 1 is formed from titanium, and the crown portion 13 from a light-weight material such as carbon fiber composite, polypropylene, Kevlar, thermoplastic, magnesium, or some other suitable light-weight material. Preferred volumes of the club head 1 include from 350 cc to 460 cc. The secondary weights 26, 28 preferably range in mass from 2 to 35 grams, with 10 grams to 35 grams being more preferred. It is well known that by varying parameters such as shaft flex points, weights and stiffness, face angles, and club lofts, it is possible to accommodate a wide spectrum of golfers. But the present invention addresses the most important launch consideration, which is to optimize the club head mass properties (center of gravity and moment of inertia) by creating a center of gravity that is low, rearward, and wide of center. The club head 1 of the present invention encompasses areas of the club head that are not typically utilized for weighting because they adversely alter the traditional look of a club head. The design of this club head 1 allows for a portion of the secondary weights 26, 28 to bulge outside the normal contour of the club head.

Figure 10:
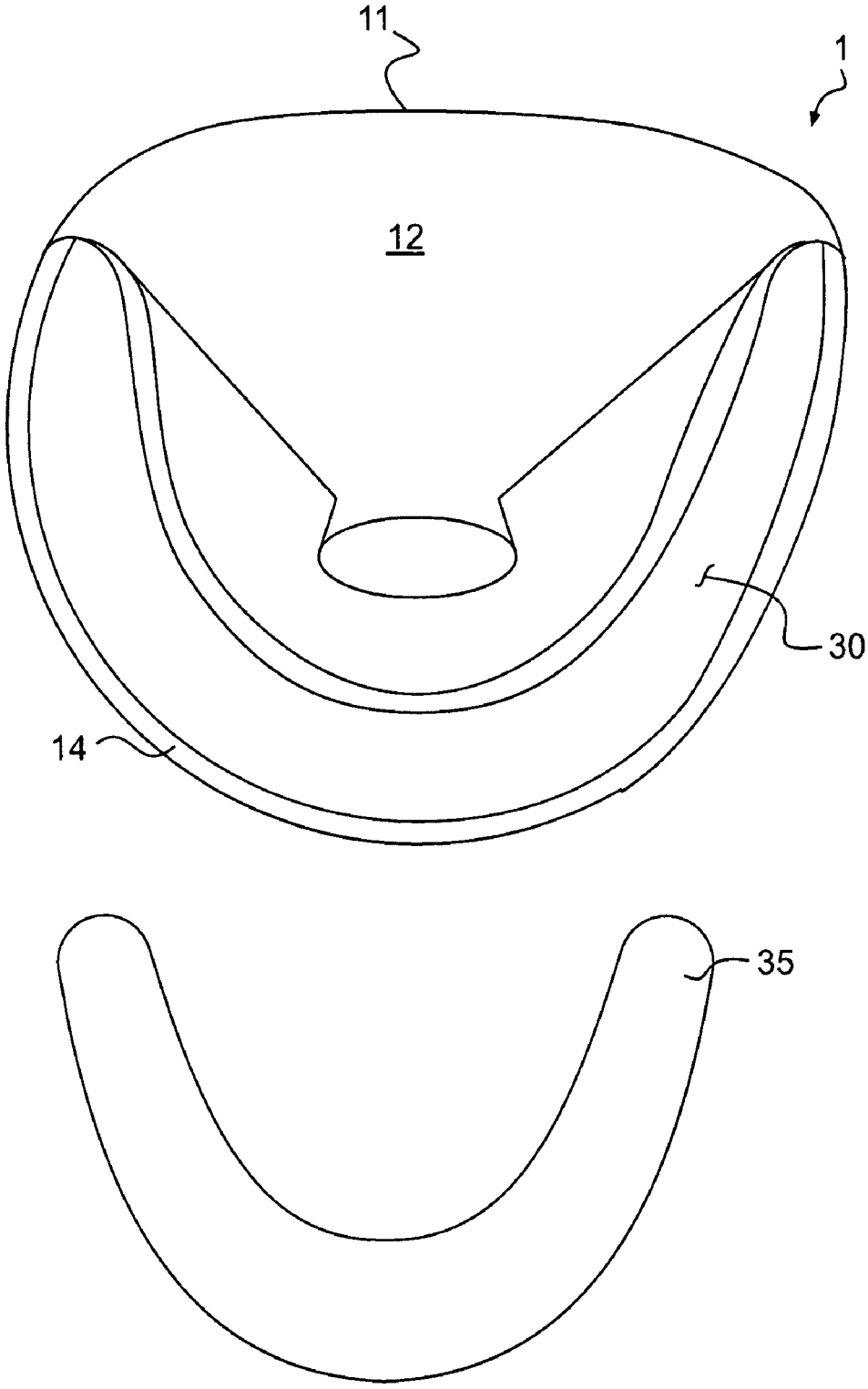
FIG. 10 shows a bottom view of a golf club head of the present invention.

FIG. 10 shows a bottom view of a golf club head 1 of the present invention. The skirt 14 includes an opening 30 towards the rear of the club head 1. An insert 35 is positioned within the opening 30 in known fashion, such as via an attachment perimeter 18, to cooperatively define the interior volume 16. Preferably, the insert 35 is formed of a light-weight material such as a composite material or a polymer material. Using a light-weight insert 35 inherently biases the club head mass toward the sole 12 of the club head 1. It also allows the inclusion of a weight member to achieve a specific moment of inertia and/or center of gravity location while maintaining typical values for the overall club head weight and mass.

Figure 22:
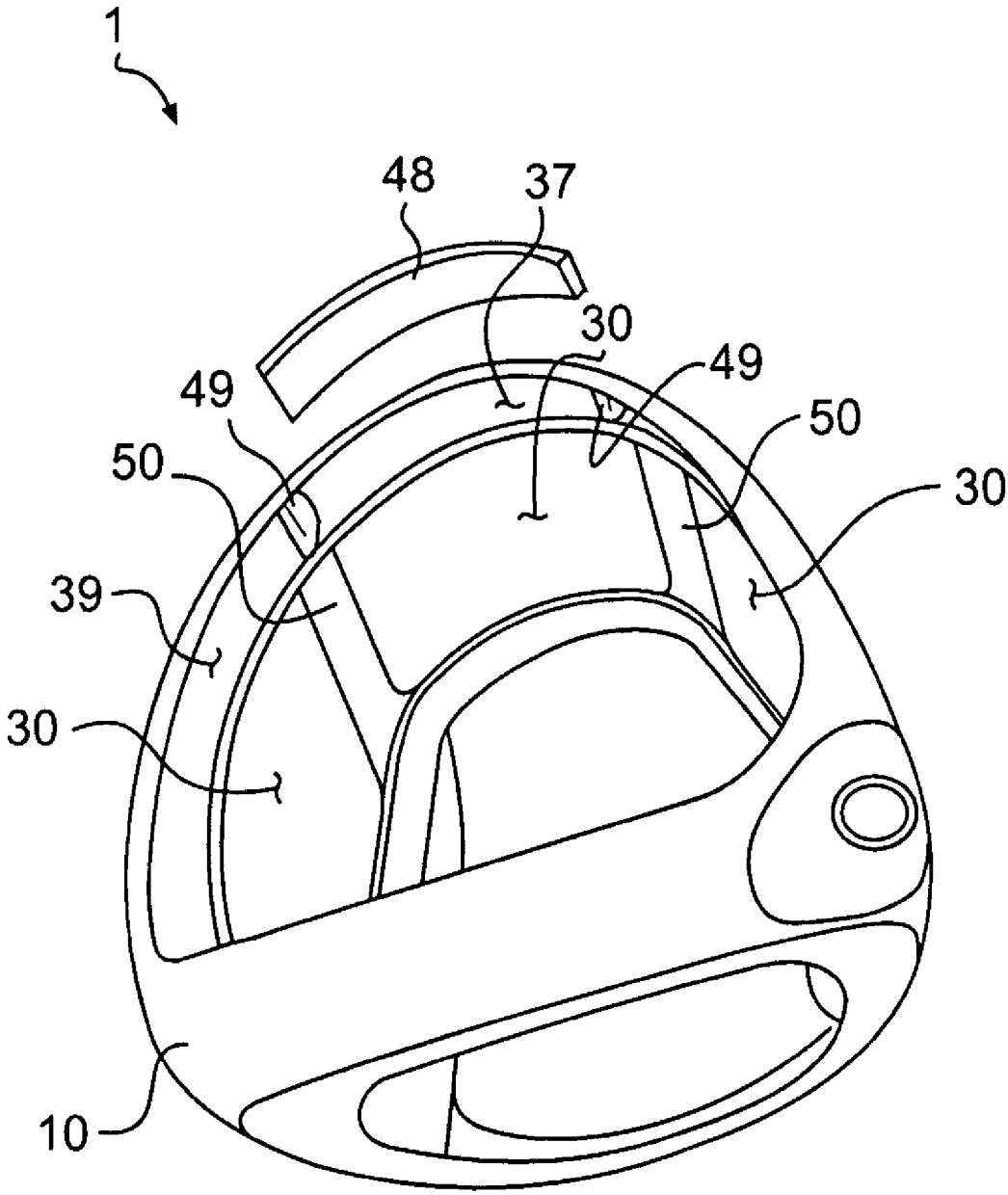
FIG. 22 shows a top isometric view of a golf club body of the present invention.

A bar or rib 50 may be used to stabilize the club head 1. The club head 1 illustrated in FIG. 22 shows a top isometric view of a golf club body 1 having two such stabilizer bars 50, one positioned on a heel side of the club head 1 and the other positioned on a toe side of the club head 1. While two bars 50 are illustrated, other numbers of bars may be used. If one stabilizer bar 50 is used, it preferably is positioned in a central portion of the club head 1. The bar(s) 50 preferably extend from a rear portion of the club head 1 near the crown 13 to the sole 12, such that the top and bottom portions of the club head 1 vibrate independently. This lessens stress and strain imposed upon the inserts 35. The bar(s) 50 thus divide the opening 30 into a plurality of openings. A single insert 35 that extends from the heel to the toe of the club head, such as illustrated in FIG. 10, may be used. Alternatively, a plurality of inserts 35, one for each of the divided portions of the opening 30, may be used. The club head body 10 of FIG. 22 is illustrated without the face insert 11, the crown insert 13, and the light weight inserts 35 for illustrative purposes. These inserts will be coupled to the body 10 as described herein or in known fashion in the finished club head 1. The opening(s) 30 may be created through the casting process for the body 10 or by removing portions of an intermediate form of the body 10, such as by laser cutting.

Figure 19:
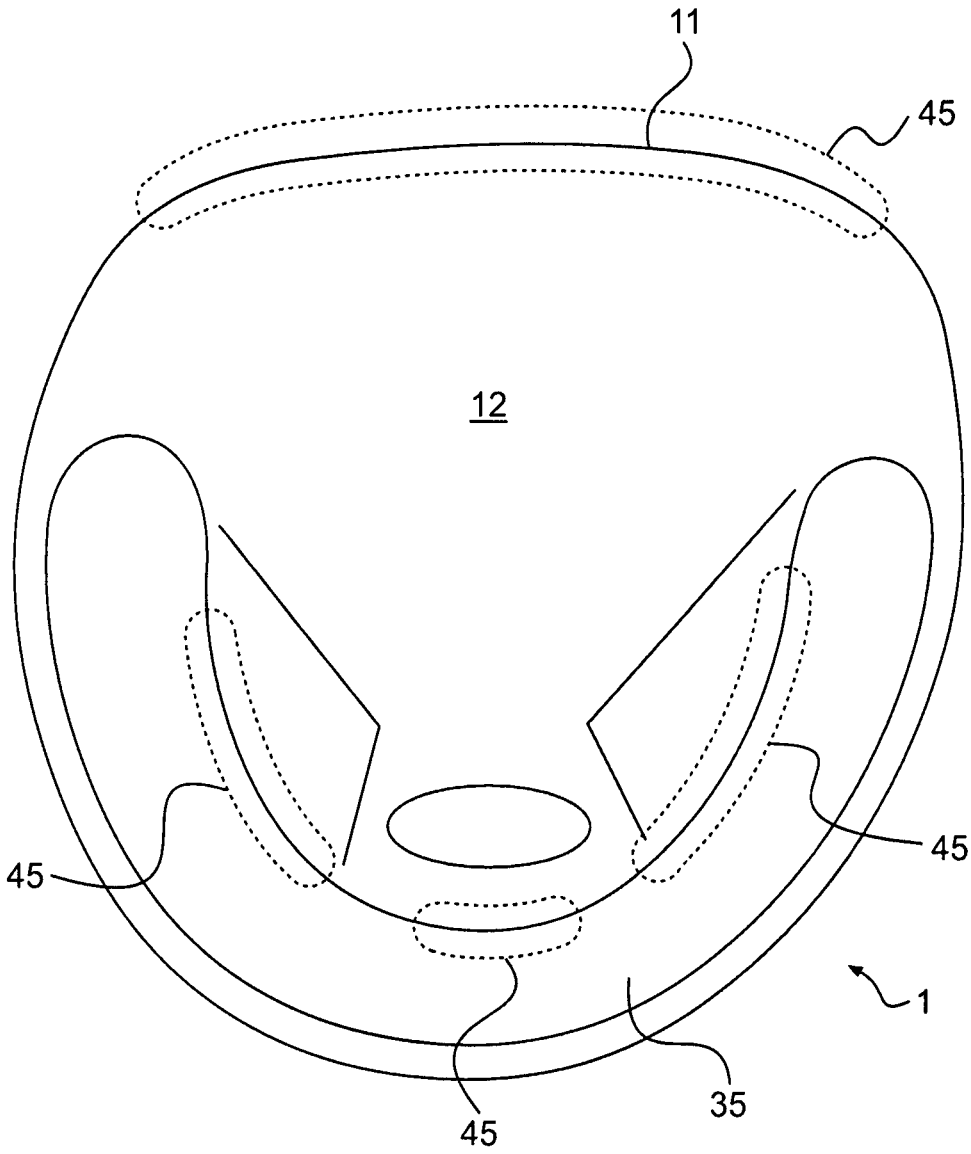
FIG. 19 shows a bottom view of a golf club head of the present invention.

As discussed above, a club head experiences stress and resulting strain during normal use of the resulting golf club, including stress imparted by impact with a golf ball. FIG. 19 shows a bottom view of a golf club head 1 of the present invention that is similar to the club head 1 illustrated in FIG. 10, with the insert 35 in place. In this illustration, those sections of the club head 1 that experience the greatest amount of stress are encircled and indicated by reference number 45. These areas include the face 11 and the front (i.e., closest to the face 11) intersection between the sole 12 and the skirt insert 35. To help ensure the club head components remain integral through the course of normal use, the attachment perimeters 18 of the insert 35 and club head body 10 are angled such that the impact stresses are imparted to the insert 35 in the form of compression rather than shear.

Figure 20:
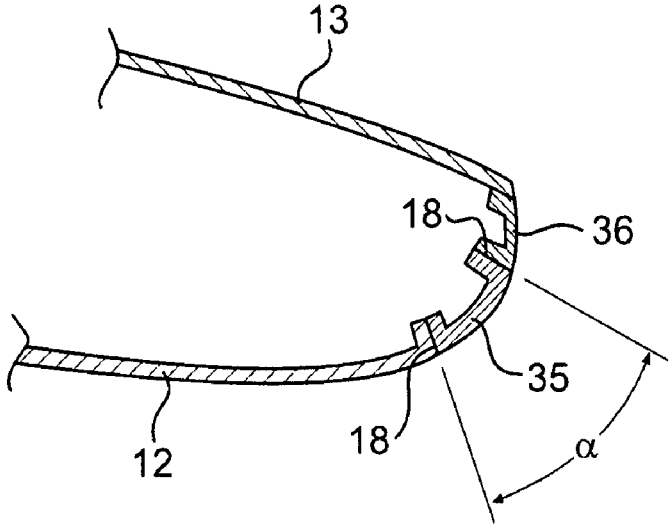
FIG. 20 shows a partial cross-sectional view through a central portion of the golf club head of FIG. 19.

FIG. 20 shows a partial cross-sectional view through a central portion of the golf club head 1 of FIG. 19. For example, the view of FIG. 20 preferably is in a vertical plane perpendicular to the club face 11 and, for example, passing through the geometric center of the club face 11. This view illustrates a crown insert 13, a sole 12, a skirt insert 35, and a portion 36 of the club head body 10. Preferably, the crown insert 13 and skirt insert 35 are light-weight, such as being formed of a composite material such as fiber-reinforced plastic. The attachment perimeters 18 of the insert 35 are angled relative to each other at an angle $\alpha$. The corresponding attachment surfaces of the sole 12 and the body portion 36 are similarly angled to matingly correspond with the attachment surfaces of the insert 35. As a result of this angling, the light-weight insert 35 experiences compressive force rather than shear force upon impact of the club head 1 with a golf ball. Compressive forces are preferred over shear forces because they tend to have a less destructive affect upon the body-insert connection. This is of particular import when an adhesive connection is used. The angle $\alpha$ preferably has a value from approximately 35° to 55°, more preferably from approximately 40° to 50°, and most preferably approximately 45°. The closer the angle $\alpha$ is to 45°, the greater the percentage of induced stress is imparted as compression force. This angle $\alpha$ may also be expressed in terms of the insert 35 alone. That is, as shown in FIG. 20, the insert 35 may include an attachment surface that is angled such that opposite portions thereof are angled at the angle $\alpha$. As used herein, opposite portions refers to portions that are approximately diametrically opposed, such as those shown in FIG. 20.

An adhesive may be used to couple the insert 35 and other club head components, such as the sole 12 and the body portion 36. A preferred adhesive is HYSOL 193051 epoxy. This adhesive, when cured, exhibits strong impact resistance and has good resistance to water, weather, oxygen, and other environmental factors.

Figure 21:
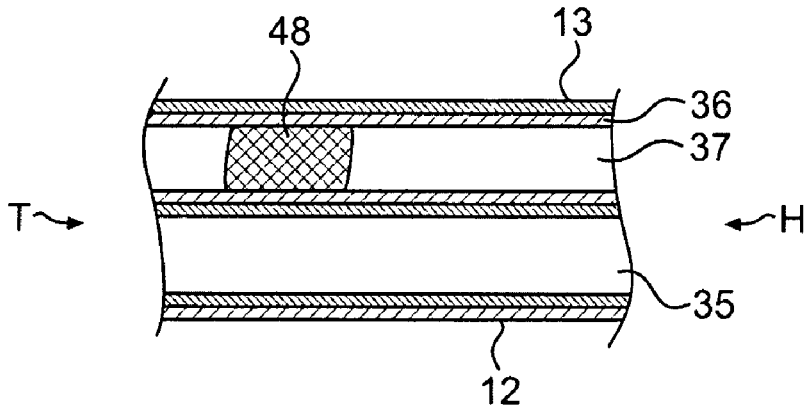
FIG. 21 shows a partial internal view of the rear portion of the club head of FIG. 19.

As shown in FIG. 20, the body portion 36 may have a u-shape such that an internal groove 37 is formed therein. As shown in FIG. 21, which shows a partial internal view of the rear portion of the club head 1 of FIGS. 19 and 20, this groove 37 extends from a heel portion of the club head 1 to a toe portion of the club head 1. A weight member 48 may strategically be placed within the groove 37. The weight member 48 may be positioned toward the heel H of the club head 1. This may be desired for a golfer that tends to slice the ball, since biasing the club head center of gravity toward the heel makes the club head easier to close, decreasing the likelihood of leaving the club head open at impact. Alternatively, the weight member 48 may be positioned toward the toe T of the club head 1. This may be desired for a golfer that tends to hook the ball, since biasing the club head center of gravity toward the toe T makes the club head harder to close, decreasing the likelihood of closing the club head too soon or too much at impact. The weight member 48 preferably has a mass within the range from 2 to 35 grams.

The club head 1 illustrated in FIG. 22 shows three separate grooves 37 into which one or more weight members 48 may be coupled. These grooves 37 are positioned within a heel portion of the body 10, a central portion of the body 10, and a toe portion of the body 10, and are separated by divider bars 49. Preferably, the weight members 48 are shaped to completely fill one of the grooves 37. This helps ensure that weight inserts are locked in place and do not become dislodged through normal use of the resulting golf club. One or more edges of the weight members 48, such as the longitudinal ends, may be tapered to collect any excess adhesive used to couple the weight members 48 to the body 10. The weight member 48 illustrated in FIG. 22 is shaped to fit within the central groove 37.

The weight member 48 may be removably or adjustably retained in place within the groove 37. For example, the weight member 48 may be retained within the groove 37 using a tongue-and-groove configuration and using a set screw to retain the weight member 38 at a specifically desired location. This configuration beneficially allows the club head designer to create a plurality of club heads with varying playing characteristics from a single club head design. This configuration also beneficially allows the club head designer or golf professional to customize the resulting golf club to a specific golfer's needs. Alternatively, the weight member 48 may be fixedly retained within the groove 37, such as by welding. The portion of the groove 37 not used to retain the weight member 38 may be filled, such as by loading this portion with an epoxy. This beneficially provides a second barrier retaining the weight member 38 in the desired location should the welds or other primary means retaining the weight member 38 in place fail.

Figure 11:
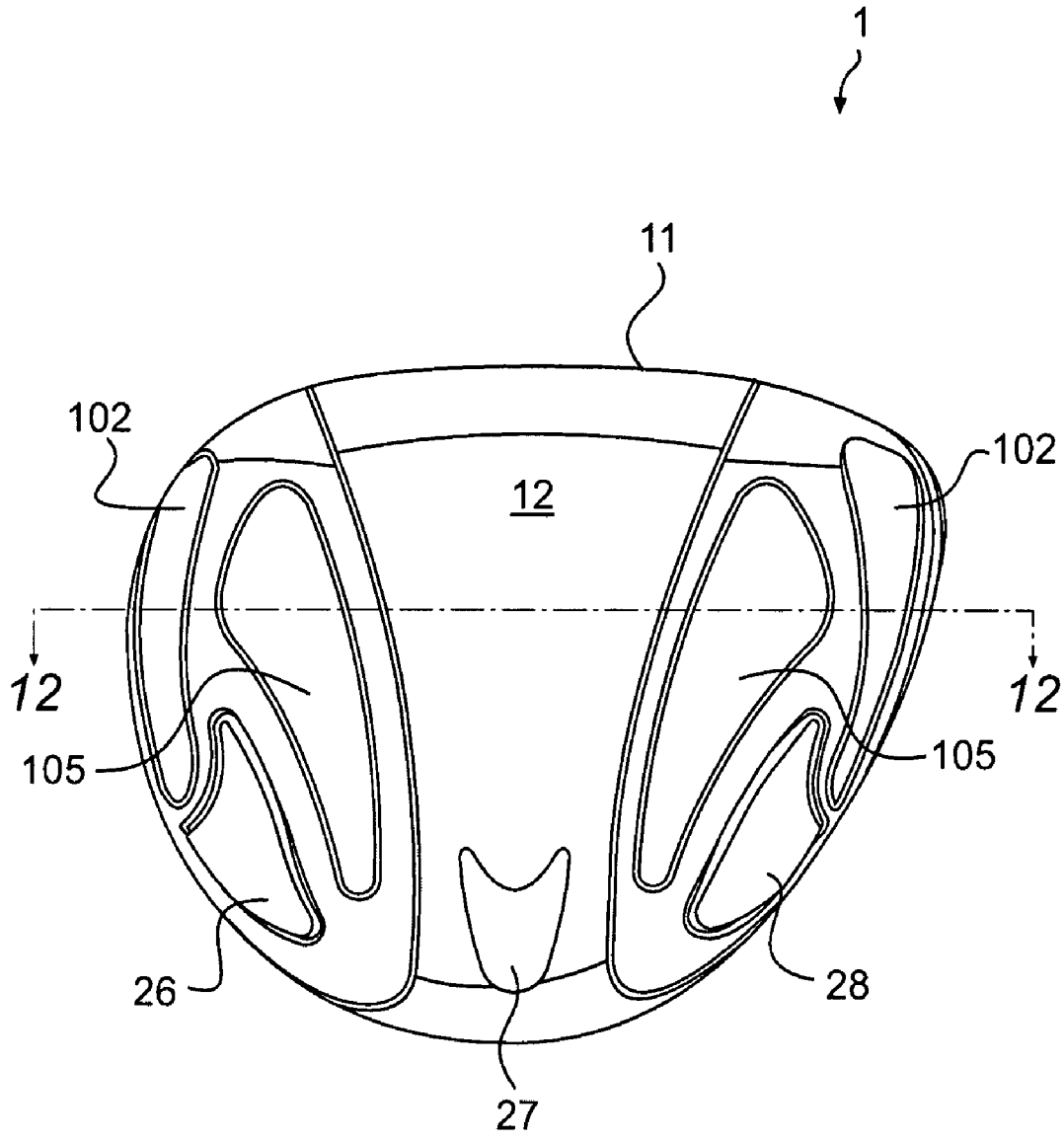
FIG. 11 shows a bottom view of a golf club head of the present invention.

FIG. 11 shows a bottom view of a golf club head 1 of the present invention. In addition to secondary weights 26, 28, the club head 1 includes an insert 27 intermediate the toe secondary weight 26 and the heel secondary weight 28. The insert 27 may be a weight insert similar to the toe and heel secondary weights 26, 28, in which case it also has a preferable mass range of 2 to 35 grams. Alternatively, or in addition to being a weight member, insert 27 may include one or more indicia, such as a model or manufacturer designation. The club head 1 further includes a sole insert 105; in the illustrated embodiment, two such sole inserts 105 are shown. These inserts 105 preferably are formed of a light-weight material as described above. Such materials likely are robust enough to withstand contact with the ground such as the sole 12 incurs through normal use of the golf club. However, the arcuate shape of the sole 12 in the illustrated embodiment minimizes the likelihood of the inserts 105 contacting the ground. Inclusion of the sole inserts 105 frees even more mass for more beneficial placement in the club head, such as at toe insert 26, intermediate insert 27, and/or heel insert 28. The location of the inserts 105 toward the center of the sole 12 inherently biases the mass toward the outer portions of the club head 1, improving the club head MOI.

Figure 12:
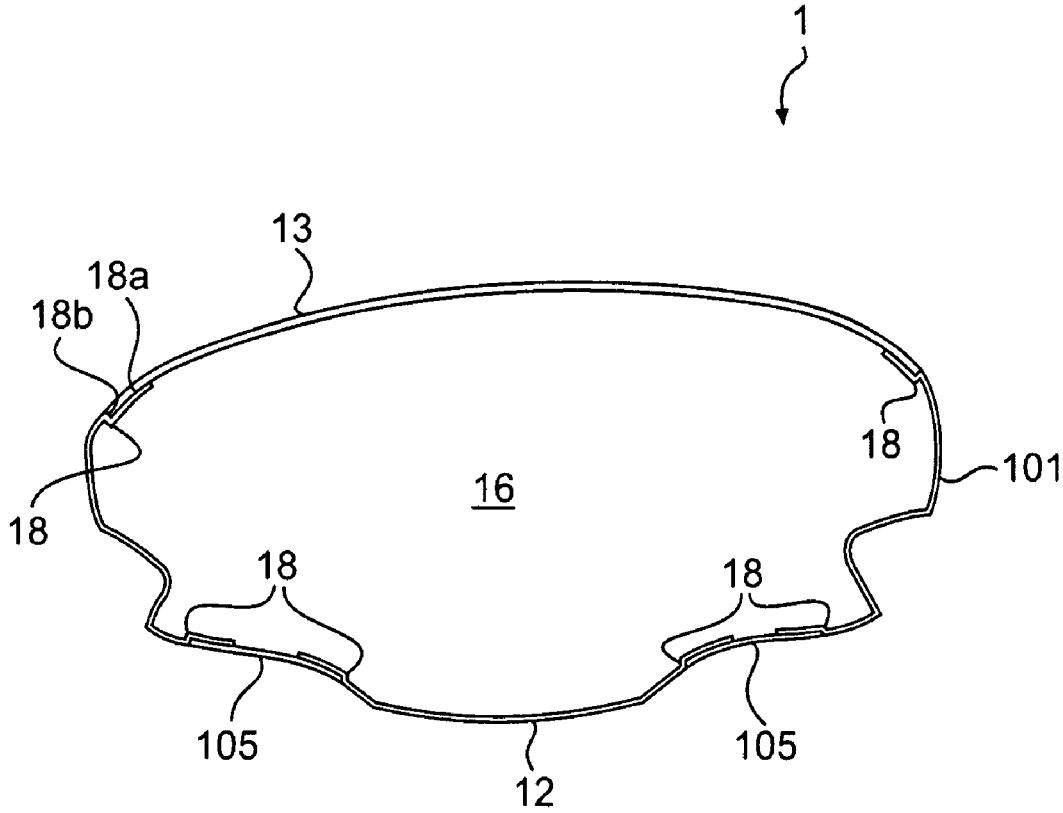
FIG. 12 shows a cross-sectional view of the club head of FIG. 11 taken along line 12-12.

FIG. 12 shows a cross-sectional view of the club head 1 of FIG. 11 taken along line 12-12. Here it is seen that the crown 13 is an insert that is coupled to the metallic first body member 101. The crown insert 13 preferably is formed of a light-weight material, beneficially displacing the club head center of gravity downward and freeing yet more weight for more beneficial placement elsewhere without increasing the overall weight of the club head 1. Due to the inclusion of holes in which to position the crown insert 13, the skirt insert 35, the second body member inserts 102, and the sole inserts 105, the first body member 101 takes on the appearance of a frame. It should be noted that not every insert 13, 35, 102, 105 need be included in a particular embodiment of the present invention, though all may be present. The frame-like nature of first body member 101 is a load bearing structure that ensures that the stresses and strains incurred during a golf swing, including those generated through striking a golf ball or the ground, do not detrimentally affect the light-weight portions of the club head 1, which experience a reduced level of stress and strain. These club head portions, which may include secondary body member 102, crown 13, skirt insert 35, and sole inserts 105, advantageously can be formed of a lighter, weight-efficient secondary material such as low density metal alloys, plastics, composites, and the like, which have a lower density or equivalent density than the previously mentioned metallic materials, beneficially allowing the club head designer to redistribute the "saved" weight or mass to other, more beneficial locations of the club head 1. These portions of the club head 1 can also be made thinner, enhancing the weight savings.

The first body member 101 preferably includes an attachment perimeter 18 for each insert (including the crown 13). These attachment perimeters 18 extend around the edge of the respective openings. Preferably, each attachment perimeter 18 includes a step defining two attachment surfaces 18*a*, 18*b*, which provide additional assurance of a strong bond between the respective club head components. (While each attachment perimeter 18 of FIG. 12 includes a step defining two attachment surfaces 18*a*, 18*b*, such attachment surfaces 18*a*, 18*b* are called-out in only one location for the sake of clarity.) In another aspect of the present invention, some or all of the attachment perimeters 18 are angled as described above.

The openings in the club head 1 into which the inserts 13, 35, 102, 105 are positioned preferably may be created by forming a complete club head shell in known fashion, and then creating the openings therein. One preferred method of creating the openings is by using a laser to remove portions of the metallic material of the first body member 101. This method provides for tight tolerances. The attachment perimeter 18, including attachment surfaces 18*a*, 18*b*, may be formed in a variety of manners, such as machining the first body member 101 after laser cutting the opening in the club head 1.

Alternatively to using adhesives and attachment surfaces 18*a*, 18*b*, the light-weight inserts 13, 35, 102, 105 may be coupled to the club head 1 by co-molding. The process of co-molding allows the insert(s) to be retained in place and coupled to the club head 1 without the need for attachment surfaces and adhesives, welding, etc. Exclusion of these traditional joining materials and structures frees more mass to be positioned in more beneficial locations in the club head 1. The club head designer is free to position the mass that would have been consumed by the attachment surfaces and the attachment media (adhesive, epoxy, weld bead, mechanical fastener, etc.) as desired to, for example, beneficially position the club head center of gravity, achieve a desired center of gravity location, achieve desired moment of inertia properties, increase the club head size, increase the club head sweet spot, etc., without increasing the overall weight of the club head.

This co-molding process may be performed in a variety of manners. In one such manner, an initial club head body is formed in known fashion. The initial club head body preferably includes one or more cavities or recesses. See, for example, opening 30 in FIG. 10. Thereafter, the initial club head body is placed within a mold. Liquid material is then inserted into the mold, filling or at least contacting the opening 30. Of course, the interior of the mold is shaped to impart the desired shape to the finished club head. The initial club head and molding material is retained within the mold for the necessary amount of time and subjected to the requisite thermal cycle(s), if appropriate for the materials used. In this manner, the light-weight molding material is affixed directly to the metallic (or other) material of the club head body. The club head, with the insert 35 intact, is then removed from the mold. Alternatively, plies of composite material, or other light-weight material, can be used instead of a liquid molding material. The molding times and temperatures will vary depending on the material(s) used, the thickness of the part(s) being formed, and other factors known to the skilled artisan. The mold may include other parts, such as an inflatable bladder, as desired by the club head designer. After the molding process is complete, or prior to the absolute completion of the molding process, as desired, the bladder is deflated and removed through a small hole in the club head body, which hole is later filled in or covered. The mold may also or alternatively be formed in part by mold pieces that are later removed from the club head interior, such as through an opening in the face that is later covered by an insert. It should be noted that the molded material need not contact the other ("major") portion of the club head along the entire opening. Rather, the major body-minor body contact need be only so much as is necessary to maintain mechanical and structural integrity of the resulting golf club. This limited contact area may be achieved, for example, through use of an inflatable bladder. Aspects of the invention discussed above, such as weights 23, 26, 28, can also be used with the co-molded sole 12.

In addition to reducing the amount and number of materials needed, co-molding also beneficially allows the use of materials not traditionally used by golf club head designers. For example, a translucent, plastic material may be used as the light-weight insert material. The thickness of the molded material can also be reduced. For example, the thickness of the co-molded insert may be from 1 to 1.2 mm. The molded insert may have a varying thickness, such as by providing a smooth inner surface and a contoured outer surface or vice versa. If a translucent material is used, the coloring and/or shading can be varied by varying the thickness of the insert.

Each sole insert 105 preferably has a mass of 0.5 gram to 10 grams, and more preferably from 1 gram to 5 grams. The sole inserts 305, as well as the other inserts, may be beveled or stepped slightly to provide a location for any excess adhesive. In one embodiment, the toe and heel sole inserts 26, 28 each have a preferred mass range of 4 grams to 7 grams, while the intermediate sole insert 27 has a preferred mass range of 2 grams to 3 grams. In one embodiment, the thickness of the club head components is tapered such that the walls are thicker towards the face 11 and thinner towards the rear of the club head 1. Such wall thickness tapering frees more mass for more beneficial placement in the club head 1.

Figure 13:
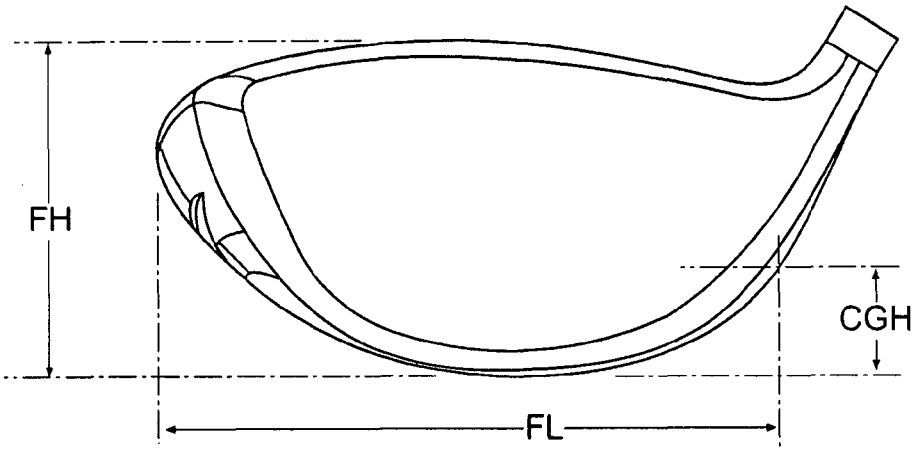
FIG. 13 shows a front view of a golf club head of the present invention.
Figure 14:
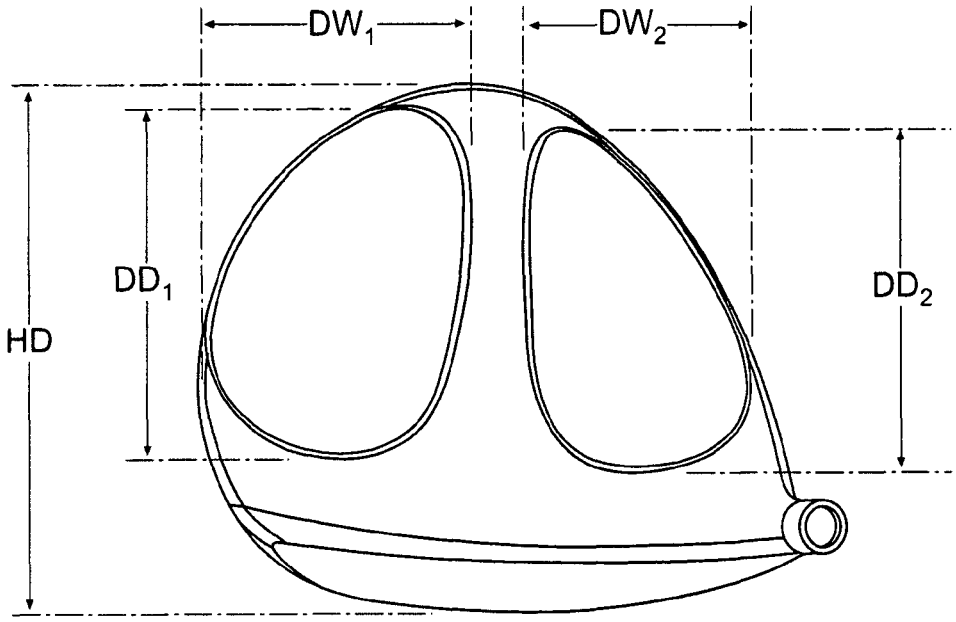
FIG. 14 shows a top view of the golf club head of FIG. 13.

In another aspect of the present invention, the face 11 is made to be relatively large. Providing a large face 11 increases the playability and forgiveness of the club head by, for example, increasing the size of the club head sweet spot and allowing for beneficial placement of weight members further away from the club head centerline. The governing bodies of the rules of golf have deemed the maximum distance from the heel to the toe of the club head to be 5 inches, and further that the maximum distance from the sole to the crown of the club head to be 2.8 inches. Thus, in a preferred embodiment illustrated in FIGS. 13 and 14, the face has a length FL (i.e., a measurement in the heel-toe direction along the widest part of the face 11) of 5 inches and a height FH (i.e., a measurement in the sole-crown direction along the tallest part of the face 11) of 2.8 inches. These dimensions may be slightly less to ensure compliance with the rules. For example, the face length FL may be from 4.5 to 5 inches, more preferably from 4.8 to 5 inches, and the face height FH may be from 2.5 to 2.8 inches, more preferably from 2.65 to 2.8 inches. The dimensions of the face 11 may also be expressed as an aspect ratio, which is the ratio of the face length FL to the face height FH. The aspect ratio for the face 11 preferably is from 1.5 to 2, more preferably from 1.7 to 1.9. The face dimensions may also be expressed as a measurement of the face surface area. Preferably, the face surface area is greater than 40 $cm^2$, more preferably greater than 45 $cm^2$, and still more preferably greater than 50 $cm^2$. A preferred range for the face surface area is from 40 $cm^2$ to 60 $cm^2$. In one preferred embodiment, the face surface area is approximately 54 $cm^2$.

In addition to having a big face 11 (i.e., wide in the heel-toe dimension (FL) and tall in the sole-crown dimension (FH)), the club head 1 may also be long in the face-rear dimension. Providing a long club head body 10 moves the club head center of gravity rearward from the face, further increasing the playability of the resulting golf club. This also allows for beneficial placement of weights far behind the face 11, and, in one embodiment, away from the club head centerline. The governing bodies of the rules of golf have deemed that the distance from the heel to the toe of the club head must be greater than the distance from the face to the back. Thus, in a preferred embodiment, the club head depth HD is just less than the club face width. Preferred dimensions for the club head depth HD may be from 4.5 to 5 inches, more preferably from 4.8 to 5 inches. Preferably, the club head depth HD is within 0.25 inch of the club head face length FL.

Preferably, the club head dimensions are measured on horizontal lines between vertical projections of the outermost points of:

the heel and the toe (dimension FL); and the face and the back (dimension HD); and on vertical lines between the horizontal projections of the outermost points of the sole and the crown (dimension FH).

COR is an important characteristic of golf clubs, especially wood-type golf clubs such as club head 1. COR is a measure of the efficiency of the transfer of energy between two colliding bodies, in this case the golf club and the golf ball. As the efficiency of the energy transfer increases, the COR, the initial ball velocity, and the ball travel distance increase. During a golf shot, the club face and the golf ball deform upon impact. The club face can deform and then recover more than the ball can. The ultimate aim of the dynamics or physics of the collision is to limit the amount of deformation the ball sustains because more energy is lost from a perfect collision due to heat, etc. in the ball. By allowing the strike face 11 to deform or deflect as much as possible over a greater percentage of the face 11, a higher performance strike face 11 can be constructed. As the amount of club face deformation increases, so do the club head COR and the forces applied to the ball. The inventive large club head 1 preferably contains a large COR, for example 0.8 or greater, and more preferably 0.82 or greater. One specific COR value that is preferred is 0.83, the maximum limit allowed by the governing bodies of golf.

Due to the increased width (heel-to-toe) of the club face 11 and the increased length (front-to-back) of the club head 1, the crown 13 has an increased surface area. This crown surface area preferably is greater than 100 $cm^2$ or from approximately 100 $cm^2$ to 150 $cm^2$, and one exemplary crown surface area is approximately 107 $cm^2$. Furthermore, a distance, substantially at the center of the club head 1, from the crown-face intersection to the crown-skirt intersection at the rear of the club head is greater than 4 inches. More preferably, this distance is greater than 4.25 inches, and more preferably greater than 4.5 inches. This distance may be measured as the trace along the crown in a vertical plane perpendicular to the club face 11 and, for example, passing through the geometric center of the club face 11.

As stated above, providing a properly balanced, large club head results in the club being more playable and forgiving. The club head 1 preferably has a volume greater than 400 $cm^3$. More preferably, this club head volume is greater than 425 $cm^3$. Still more preferably, the club head volume is greater than 450 $cm^3$. The governing bodies of the rules of golf have deemed the club head must not exceed 460 $cm^3$, with a tolerance of 10 $cm^3$. Thus, the club head volume should satisfy the limitations imposed by the governing bodies.

Figure 15:
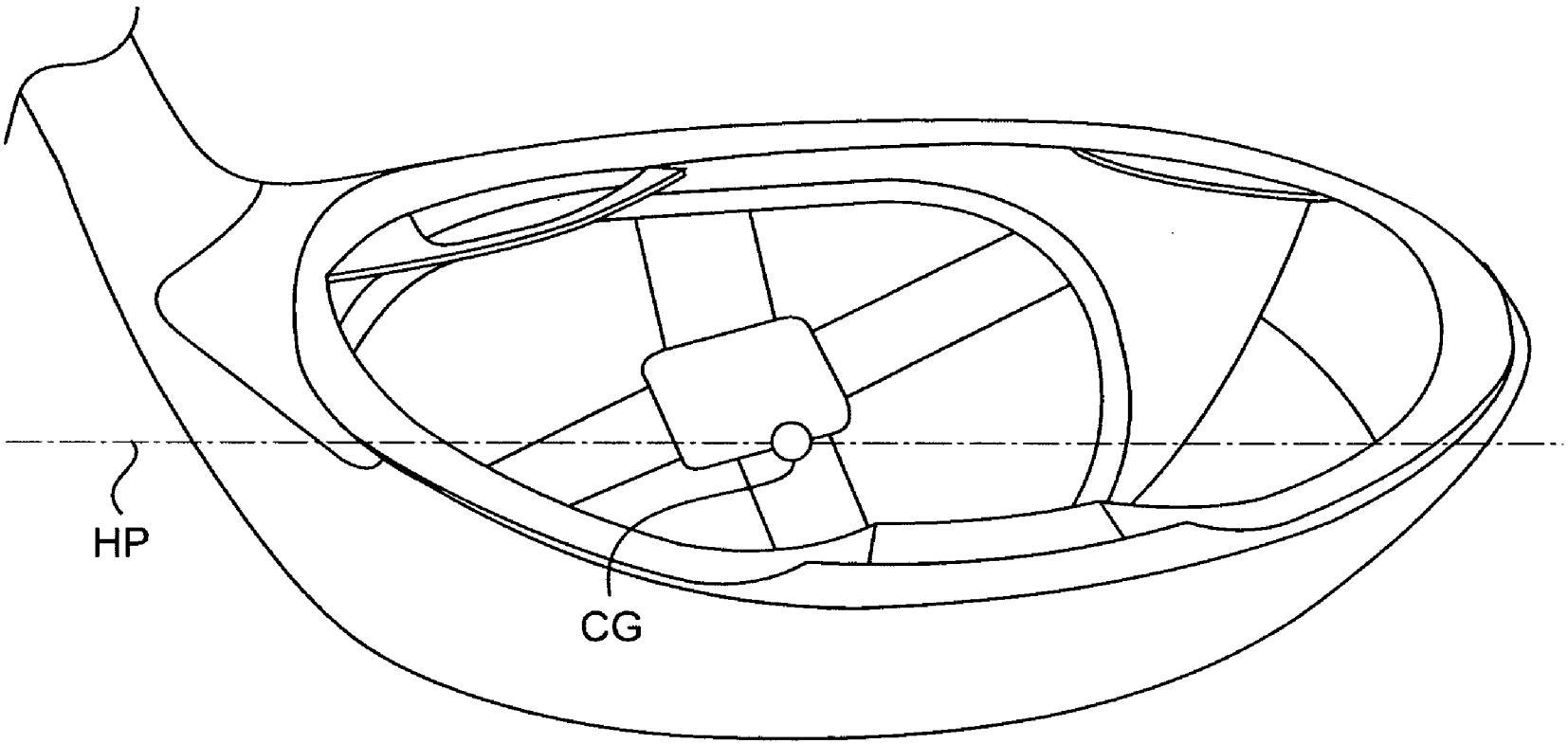
FIG. 15 shows a rear view of a golf club head of the present invention with the crown removed.
Figure 16:
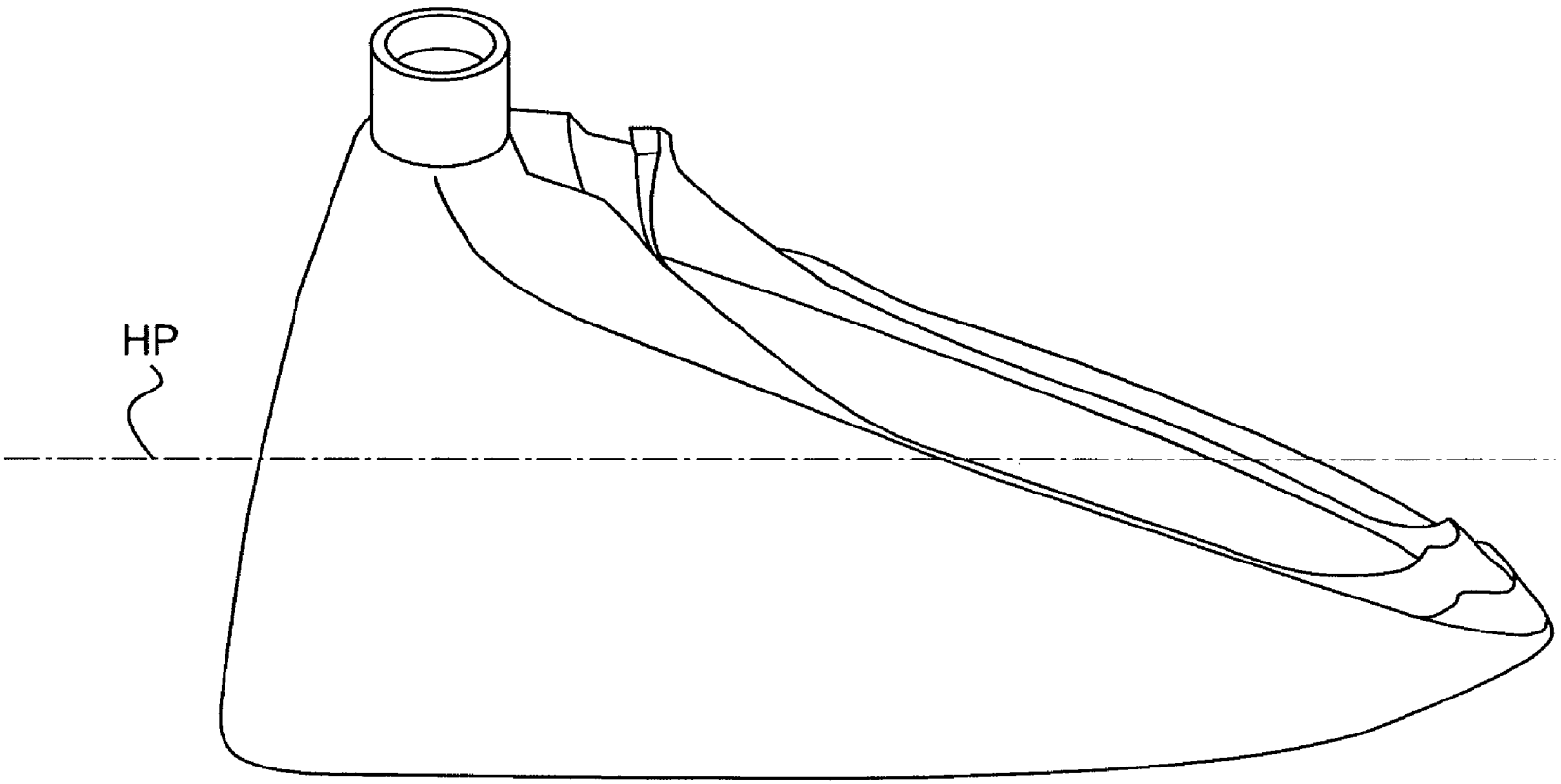
FIG. 16 shows a heel view of the golf club head of FIG. 15.
Figure 17:
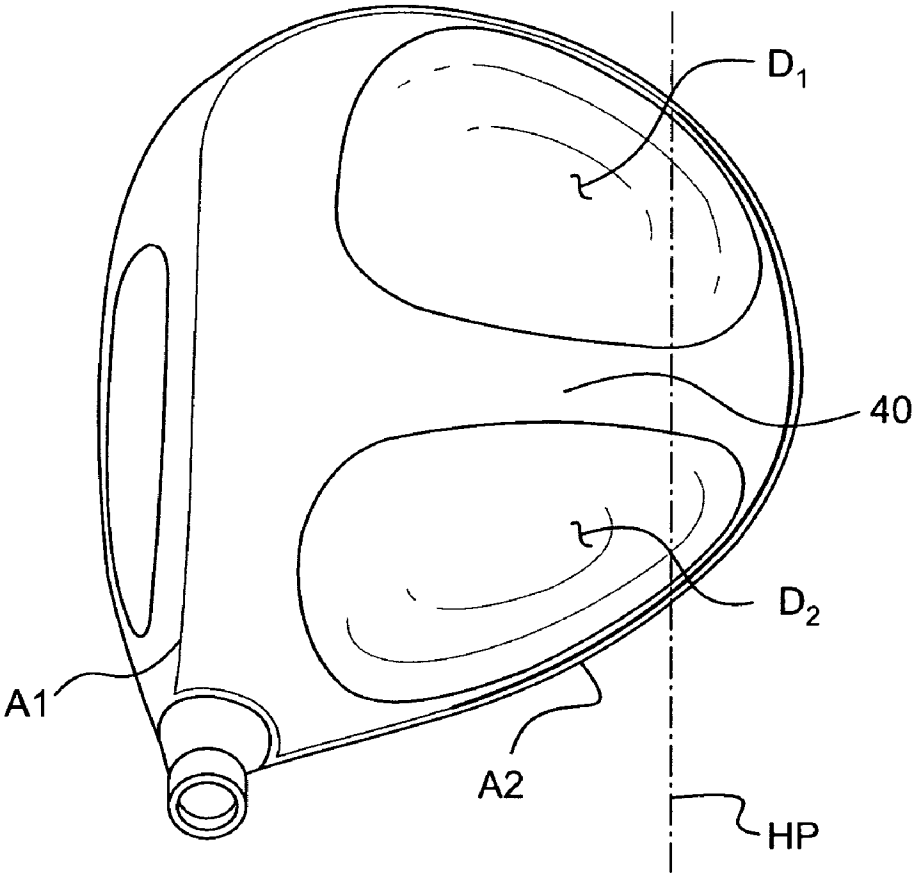
FIG. 17 shows a top view of the golf club head of FIG. 15 with the crown in place.

To position the club head center of gravity toward the sole 12 and to increase the club head MOI, which makes the club head 1 more forgiving and playable, the crown 13 of the club head 1 may have a unique design. According to this aspect of the invention, at least 35% of the club head outer periphery is positioned below the club head center of gravity. As used here, outer periphery is defined as the arc length of the outermost area of the crown 13. This aspect is illustrated in FIGS. 15-17. Turning first to FIG. 15, a rear view of the club head 1 (with the crown 13 removed) is shown. A horizontal plane HP passing through the club head center of gravity CG is shown for reference purposes. As seen in FIG. 16, which shows a heel view of the club head of FIG. 15, the club head body 10 and the crown 13 (not shown) slope downward from the front to the rear portions of the club head 1. FIG. 17 shows a top view of the golf club head of FIG. 15 with the crown 13 in place. Due to the sloped crown profile, a large portion of the crown 13 is below the club head center of gravity CG. The outer periphery of the crown 13 is comprised of two arc lengths, A1 and A2. A1, which is illustrated in a heavy solid line in FIG. 17, indicates that portion of the crown outer periphery that is above the club head center of gravity CG. A2, which is illustrated in a heavy dashed line in FIG. 17, indicates that portion of the crown outer periphery that is below the club head center of gravity CG. In the exemplary embodiment illustrated in FIG. 17, 35% of the crown outer periphery is below the club head center of gravity CG. In another preferred embodiment, 40% of the crown outer periphery is below the club head center of gravity CG. In still another preferred embodiment, 45% of the crown outer periphery is below the club head center of gravity CG. In another preferred embodiment, the rear height of the club head 1 is less than or equal to 25% of the front height of the club head 1.

Figure 18:
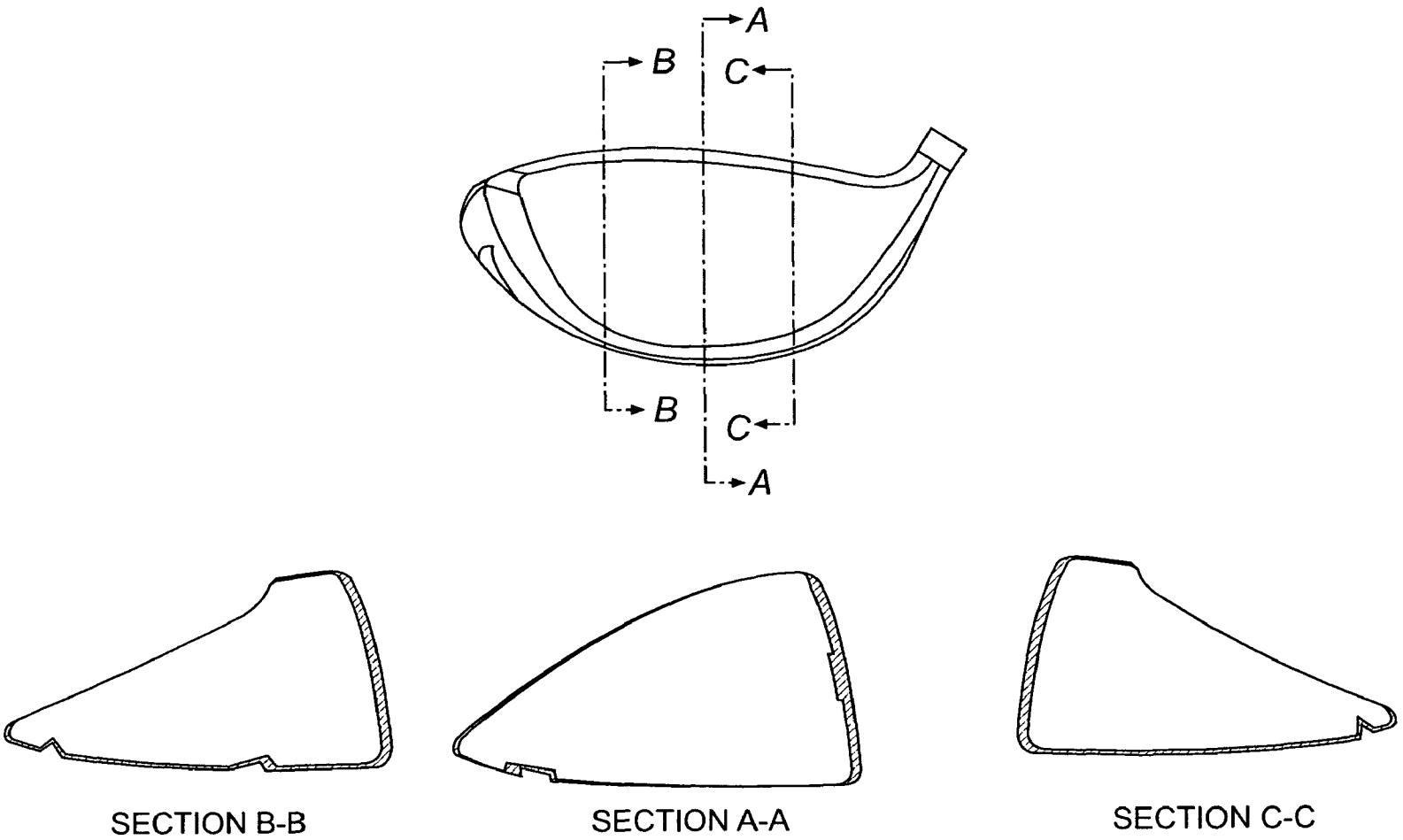
FIG. 18 shows a front view of a golf club head of the present invention and three cross-sectional views therethrough.

A structural or stiffening rib 40 to absorb and transmit stress and strain generated during normal use of the resulting golf club may be provided. One beneficial location for such a rib 40 is along a central portion of the crown, with a curved, convex profile (when viewed from above the club head 1). As the rib 40 manages the brunt of the stress and strain generated during use of the golf club, other portions of the crown 13 may be designed to enhance the playability of the golf club. For example, the crown 13 may contain concave dimples $D_1$, $D_2$. Dimples $D_1$, $D_2$ lower the crown profile, which in turn lowers the club head center of gravity. Preferred dimensions for the dimple $D_1$, which is biased toward the club head toe, are: 2.9 to 3.5 inches for the depth $DD_1$, with 3 to 3.3 being more preferred; 2.2 to 2.6 inches for the width $DW_1$, with 2.3 to 2.5 inches being more preferred. Preferred dimensions for the dimple $D_2$, which is biased toward the club head heel, are: 2.8 to 3.4 inches for the depth $DD_2$, with 3.1 to 3.3 being more preferred; 1.9 to 2.3 inches for the width $DW_2$, with 2 to 2.2 inches being more preferred. Alternatively, the dimples $D_1$, $D_2$ can be identical. However, to achieve a properly balanced club head, in light of factors such as the presence of the hosel 15 and the club head par area, the dimples $D_1$, $D_2$ may be of different size and dimension, as provided above. Preferably, the center of gravity height CGH, as measured from the sole 12, is less than 1 inch. Alternatively, the center of gravity height CGH may be from 0.7 to 1.1 inch, and more preferably 0.8 to 0.9 inch. These concepts are illustrated in FIG. 18, which shows a front view of the golf club head and three cross-sectional views. Section A-A is through a central portion of the club head, section B-B is through a toe portion of the club head, and section C-C is through a heel portion of the club head.

To remove yet more weight from the upper portions of the club head, the crown, or portions of the crown, can be provided in a light-weight material, such as discussed with respect to the second body member 102 above. The entire crown 13 may be formed of such light-weight material, or only portions of the crown, such as dimples $D_1$ and/or $D_2$ may be formed of light-weight material. It should be noted that "light-weight material" includes thin portions of metal or other typically heavy material. The curved profile of the crown 13, described above, helps to ensure that the structural integrity of the crown 13 is maintained.

The above-described club head attributes also impart a beneficial MOI to the club head 1. Preferably, the club head 1 has a MOI about a horizontal axis passing through the club head center of gravity of 260 $kg \cdot mm^2$ or greater, and a MOI about a vertical axis passing through the club head center of gravity of 420 $kg \cdot mm^2$ or greater. More preferably these MOI values are 270 $kg \cdot mm^2$ and 450 $kg \cdot mm^2$, respectively. Still more preferably MOI values are 280 $kg \cdot mm^2$ and 470 $kg \cdot mm^2$, respectively. Top range MOI values may be 350 $kg \cdot mm^2$ and 550 $kg \cdot mm^2$, respectively.

The use of the terms "a" and "an" and "the" and similar references in the context of describing the invention are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein.

As used herein, directional references such as rear, front, lower, etc. are made with respect to the club head when grounded at the address position. See, for example, FIG. 9. The direction references are included to facilitate comprehension of the inventive concepts disclosed herein, and should not be read as limiting.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. For example, while two body members have been described above, the present invention may be embodied in a club head having more than two body members. Additionally, the present invention may be embodied in any type of club in addition to the wood-type clubs shown in the illustrated embodiments. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. A golf club head, comprising:

a body having a striking face, a sole, a crown, a heel, a toe, and a skirt defining a shell;

a skirt insert positioned within a hole defined in the skirt, wherein the skirt insert has an attachment surface that is angled such that the skirt insert is in a state of compression upon impact of the striking face with a golf ball during a golf swing of the club head, wherein the skirt comprises a body portion coupled to the crown and the skirt insert that defines an internal groove, and wherein a weight member is disposed within the internal groove.

2. The golf club head of claim 1, wherein said attachment surface is angled such that opposing surfaces thereof are angled at an angle from approximately 35° to 55°.

3. The golf club head of claim 2, wherein said angle is from approximately 40° to 50°.

4. The golf club head of claim 1, wherein:

the crown comprises a crown insert.

5. The golf club head of claim 4, wherein the crown insert and the skirt insert are formed of a light-weight material.

6. The golf club head of claim 1, further comprising two stabilizer bars extending across the hole from the body portion to a position adjacent the sole.

7. The golf club head of claim 1, wherein the weight member has a mass from 2 grams to 35 grams.

8. The golf club head of claim 1, wherein said striking face has a surface area greater than 40 $cm^2$.

9. The golf club head of claim 1, wherein:

said striking face has a width measured in a heel-toe direction and a height measured in a sole-crown direction; and said width divided by said height defines an aspect ratio that is greater than 1.5.

10. The golf club head of claim 9, wherein the head has a depth measured in a face-rear direction that is within 0.25 inch of said width.

11. The golf club head of claim 1, wherein said crown has a surface area greater than 100 $cm^2$.

12. The golf club head of claim 1, further comprising a first weight insert positioned on a toe side of said sole and a second weight insert positioned on a heel side of said sole, each of said first and second weight inserts having a mass from 2 grams to 35 grams.

13. The golf club head of claim 1, wherein the club head has a volume greater than 400 $cm^3$.

14. The golf club head of claim 1, wherein a distance measured substantially at a center of the club head from a crown-face intersection to a rear edge of said crown is greater than 4 inches.

15. The golf club head of claim 1, wherein:

the club head has a center of gravity; and at least 35% of said outer periphery is on a sole side of the center of gravity.

16. The golf club head of claim 15, wherein at least 40% of said outer periphery is on a sole side of the center of gravity.

17. The golf club head of claim 16, wherein said crown includes a stiffening rib and at least one depressed region.

18. The golf club head of claim 1, wherein:

the club head has a center of gravity; and the club head has a moment of inertia about a vertical axis passing through the center of gravity of 260 $kg \cdot mm^2$ or greater.

19. The golf club head of claim 18, wherein the club head has a moment of inertia about a horizontal axis passing through the center of gravity of 420 $kg \cdot mm^2$ or greater.

20. The golf club head of claim 1, further comprising a stabilizer bar extending across the hole from a position adjacent said crown the body portion to a position adjacent the sole.

21. The golf club head of claim 1, wherein the internal groove extends from a heel portion to a toe portion.

22. The golf club head of claim 1, wherein the internal groove is separated by divider bars into a first groove located in a heel portion, a second groove located in a central portion, and a third groove located in a toe portion.

23. The golf club head of claim 22, wherein each of the first, second, and third grooves comprise weight inserts.

24. The golf club head of claim 1, wherein the weight member is positioned toward the heel of the club head.

25. The golf club head of claim 1, wherein the weight member is positioned toward the toe of the club head.

* * * * *

UNITED STATES PATENT AND TRADEMARK OFFICE

CERTIFICATE OF CORRECTION

PATENT NO. : 7,803,065 B2
APPLICATION NO. : 11/898756
DATED : September 28, 2010
INVENTOR(S) : Joshua G. Breier et al.

It is certified that error appears in the above-identified patent and that said Letters Patent is hereby corrected as shown below:

In Column 18, Line 11, in Claim 20, before "the body", please delete "said crown".

Signed and Sealed this
Seventeenth Day of May, 2011

David J. Kappos

David J. Kappos
*Director of the United States Patent and Trademark Office*